US007665967B1

(12) United States Patent
Parker et al.

(10) Patent No.: US 7,665,967 B1
(45) Date of Patent: Feb. 23, 2010

(54) EFFICIENT TRADITIONALLY APPEARING CEILING FAN BLADES WITH AERODYNAMICAL UPPER SURFACES

(75) Inventors: Danny S. Parker, Cocoa Beach, FL (US); Bart Hibbs, Altadena, CA (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 336 days.

(21) Appl. No.: 11/389,318

(22) Filed: Mar. 24, 2006

Related U.S. Application Data

(63) Continuation-in-part of application No. 29/252,288, filed on Jan. 20, 2006, now Pat. No. Des. 594,551.

(51) Int. Cl.
*F04D 29/00* (2006.01)

(52) U.S. Cl. ..... 416/62; 416/223 R; 416/5

(58) Field of Classification Search ..... 416/5, 416/223 R, 243
See application file for complete search history.

(56) References Cited

U.S. PATENT DOCUMENTS

| | | | | |
|---|---|---|---|---|
| 1,455,591 | A | 5/1923 | Lawson | |
| 1,757,292 | A | 5/1930 | Caldwell | |
| 2,283,956 | A | 5/1942 | Smith | 170/159 |
| 2,336,012 | A * | 12/1943 | Hackethal | 416/209 |
| 4,626,172 | A * | 12/1986 | Mouille et al. | 416/134 A |
| 4,892,460 | A | 1/1990 | Volk | 416/62 |
| D330,077 | S | 10/1992 | Davis | D23/413 |
| 5,344,235 | A | 9/1994 | Weetman et al. | 366/270 |
| D364,224 | S | 11/1995 | Wang | D23/377 |
| D371,838 | S | 7/1996 | Davis, Jr. et al. | D23/411 |
| D378,404 | S | 3/1997 | Jaspers-Fayer | D23/377 |
| 5,681,145 | A | 10/1997 | Neely et al. | 416/203 |
| D387,156 | S | 12/1997 | Johnson | D23/411 |
| D402,026 | S | 12/1998 | Chuang et al. | D23/377 |
| D408,518 | S | 4/1999 | Liu | D23/377 |
| D412,571 | S | 8/1999 | Lee | D23/377 |
| D414,856 | S | 10/1999 | Zuege | D23/377 |
| D421,799 | S | 3/2000 | Zuege | D23/411 |
| D422,072 | S | 3/2000 | Blateri | D23/377 |
| 6,039,541 | A | 3/2000 | Parker et al. | 416/223 |
| 6,146,097 | A * | 11/2000 | Bradt | 416/5 |
| 6,183,201 | B1 * | 2/2001 | Maby | 416/170 R |
| D443,352 | S | 6/2001 | Lantz | D23/413 |
| D451,997 | S | 12/2001 | Schwartz | D23/413 |

(Continued)

*Primary Examiner*—Edward Look
*Assistant Examiner*—Dwayne J White
(74) *Attorney, Agent, or Firm*—Brian S. Steinberger; Law Offices of Brian S. Steinberger, P.A.

(57) ABSTRACT

Efficient traditionally appearing ceiling fan blades with aerodynamical upper surfaces and wide tip ends for ceiling fans with blades formed from plastic and/or wood and/or separately attached surfaces that run at reduced energy consumption that move larger air volumes than traditional flat shaped ceiling fan blades. And methods of operating the novel ceiling fans blades for different speeds of up to and less than approximately 250 rpm. The novel blades twisted blades can be configured for ceiling fans having any diameters from less than approximately 32 inches to greater than approximately 64 inch fans, and can be used in two, three, four, five and more blade configurations. The novel fans can be run at reduced speeds, drawing less Watts than conventional fans and still perform better with more air flow and less problems than conventional flat type conventional flat and planar upper and lower surface blades.

11 Claims, 36 Drawing Sheets

U.S. PATENT DOCUMENTS

| | | | | |
|---|---|---|---|---|
| D453,566 | S | 2/2002 | Lantz | D23/413 |
| D454,636 | S | 3/2002 | Lantz | D23/413 |
| 6,428,277 | B1 | 8/2002 | Holmes | 416/192 |
| 6,494,589 | B1 | 12/2002 | Shyu | 362/96 |
| D469,950 | S | 2/2003 | Scalise et al. | D3/3 |
| D480,471 | S | 10/2003 | Hsieh | D23/411 |
| D480,473 | S | 10/2003 | Thomas, Jr. | D23/413 |
| D484,233 | S | 12/2003 | Bucher et al. | D23/377 |
| 6,659,721 | B1 | 12/2003 | Parker et al. | 416/5 |
| D485,345 | S | 1/2004 | Bucher | D23/377 |
| D485,346 | S | 1/2004 | Bucher et al. | D23/377 |
| D485,347 | S | 1/2004 | Bucher et al. | D23/377 |
| 6,719,532 | B2 | 4/2004 | Bird | 416/210 |
| 6,719,533 | B2 | 4/2004 | Bird | 416/210 |
| 6,733,241 | B2 | 5/2004 | Bird | 416/238 |
| D491,657 | S | 6/2004 | Cartwright | D23/413 |
| 6,884,034 | B1 | 4/2005 | Parker et al. | 416/1 |
| 6,890,155 | B2 | 5/2005 | Cartwright | 416/229 |
| 6,899,525 | B2 | 5/2005 | Vanmoor | 416/223 |
| 6,923,624 | B2 | 8/2005 | Tsai | 416/231 |
| D510,992 | S | 10/2005 | Bucher | D23/377 |
| 2003/0202881 | A1* | 10/2003 | MacCuaig | 416/62 |
| 2004/0258530 | A1 | 12/2004 | Oono et al. | 416/223 |
| 2005/0002790 | A1* | 1/2005 | Lin | 416/210 R |
| 2006/0210401 | A1* | 9/2006 | Shahin et al. | 416/210 R |

* cited by examiner

EFFICIENT TRADITIONALLY APPEARING CEILING FAN BLADES WITH AERODYNAMICAL UPPER SURFACES

This invention is a Continuation-In-Part of Design application Ser. No. 29/252,288 filed Jan. 20, 2006 now U.S. Pat. No. Des. 594,551.

FIELD OF INVENTION

This invention relates to ceiling fans, and in particular to efficient traditionally appearing ceiling fan blades with aerodynamical upper surfaces and wide tip ends for ceiling fans with blades formed from plastic and/or wood and/or be separately attached as an upper surface, that run at reduced energy consumption that move larger air volumes than traditional flat shaped ceiling fan blades, and to methods of operating the novel ceiling fans.

BACKGROUND AND PRIOR ART

Existing flat planar appearing ceiling fans are the most popular type of ceiling fans sold in the United States, and are known to have relatively poor air moving performance at different operating speeds. See for example U.S. Pat. Nos. Des. 355,027 to Young and Des. 382,636 to Yang. These patents while moving air are not concerned with maximizing optimum downward airflow.

Additionally, many of the flat ceiling fan blades have problems such as wobbling, and excessive noise that is noticeable to persons in the vicinity of the fan blades. The flat planar rectangular blade can have a slight tilt to increase air flow but are still poor in air moving performance, and continue to have the other problems mentioned above.

Aircraft, marine and automobile engine propeller type blades have been altered over the years to shapes other than flat rectangular. See for example, U.S. Pat. Nos. 1,903,823 to Lougheed; 1,942,688 to Davis; 2,283,956 to Smith; 2,345,047 to Houghton; 2,450,440 to Mills; 4,197,057 to Hayashi; 4,325,675 to Gallot et al.; 4,411,598 to Okada; 4,416,434 to Thibert; 4,730,985 to Rothman et al. 4,794,633 to Hickey; 4,844,698 to Gornstein; 5,114,313 to Vorus; and 5,253,979 to Fradenburgh et al.; Australian Patent 19,987 to Eather.

However, these patents are generally used for high speed water, aircraft, and automobile applications where the propellers are run at high revolutions per minute (rpm) generally in excess of 500 rpm. None of these propellers are designed for optimum airflow at low speeds of less than approximately 200 rpm which is the desired speeds used in overhead ceiling fan systems.

Some alternative blade shapes have been proposed for other types of fans. See for example, U.S. Pat. Nos. 1,506,937 to Miller; 2,682,925 to Wosik; 4,892,460 to Volk; 5,244,349 to Wang; Great Britain Patent 676,406 to Spencer; and PCT Application No. WO 92/07192.

Miller '937 requires that their blades have root "lips 26" FIG. 1 that overlap one another, and would not be practical or useable for three or more fan blade operation for a ceiling fan. Wosik '925 describes "fan blades . . . particularly adapted to fan blades on top of cooling towers such for example as are used in oil refineries and in other industries.", column 1, lines 1-5, and does not describe any use for ceiling fan applications.

The Volk '460 patent by claiming to be "aerodynamically designed" requires one curved piece to be attached at one end to a conventional planar rectangular blade. Using two pieces for each blade adds extreme costs in both the manufacturing and assembly of the ceiling itself. Furthermore, the grooved connection point in the Volk devices would appear to be susceptible to separating and causing a hazard to anyone or any property beneath the ceiling fan itself. Such an added device also has necessarily less than optimal aerodynamic properties.

Tilted type design blades have also been proposed over the years. See for example, U.S. Pat. No. D451,997 to Schwartz.

However, none of the prior art modifies design shaped blades to optimize twist angles to optimize energy consumption and airflow, and reduce wobble and noise problems.

The inventors and assignee of the subject invention have been at the forefront of inventing high efficiency ceiling fans by using novel twisted blade configurations. See for example, U.S. Pat. Nos. 6,884,034 and 6,659,721 and 6,039,541 to Parker et al.

However, these fans have unique and to some a futuristic appearance as compared to traditional flat planar fan blades. Although, highly efficient, some consumers may tend to prefer the traditional flat planar blades that have been widely used as compared to the high efficiency ceiling fans that use twisted blades.

Thus, the need exists for better performing traditionally appearing ceiling fan blades over the prior art.

SUMMARY OF THE INVENTION

The first objective of the subject invention is to provide efficient ceiling fan blades, devices, apparatus and methods of operating ceiling fans, that preserve the traditional appearance of conventional flat planar ceiling fan blades when viewed underneath the ceiling fans.

The second objective of the subject invention is to provide efficient traditionally appearing ceiling fan blades, devices, apparatus and methods of operating ceiling fans, where the blades have aerodynamical upper surfaces.

The third objective of the subject invention is to provide efficient traditionally appearing ceiling fan blades, devices, apparatus and methods of operating ceiling fans, which move up to approximately 20% and greater airflow over traditional planar blades.

The fourth objective of the subject invention is to provide efficient traditionally appearing ceiling fan blades, devices, apparatus and methods of operating ceiling fans, that are less prone to wobble than traditional flat planar ceiling fan blades.

The fifth objective of the subject invention is to provide efficient traditionally appearing ceiling fan blades, devices, apparatus and methods of operating ceiling fans, that reduce electrical power consumption and are more energy efficient over traditional flat planar ceiling fan blades.

The sixth objective of the subject invention is to provide efficient traditionally appearing ceiling fan blades, devices, apparatus and methods of operating ceiling fans, designed for superior airflow at up to approximately 240 revolutions and more per minute (rpm).

The seventh objective of the subject invention is to provide efficient traditionally appearing ceiling fan blades, devices, apparatus and methods of operating ceiling fans, that are at least as aesthetically appealing as traditional flat planar ceiling fan blades.

The eighth objective of the subject invention is to provide efficient traditionally appearing ceiling fan blades, devices, apparatus and methods of operating ceiling fans, capable of reduced low operational speeds for reverse operation to less than approximately 40 revolutions per minute or less.

The ninth objective of the subject invention is to provide efficient traditionally appearing ceiling fan blades, devices, apparatus and methods of operating ceiling fans, capable of reduced low operational forward speeds of less than approximately 75 revolutions per minute or less.

The tenth objective of the subject invention is to provide efficient traditionally appearing ceiling fan blades, devices, apparatus and methods of operating ceiling fans, capable of reduced medium operational forward speeds of up to approximately 120 revolutions per minute, that can use less than approximately 9 Watts at low speeds.

The eleventh objective of the subject invention is to provide efficient traditionally appearing ceiling fan blades, devices, apparatus and methods of operating ceiling fans, that can have up to approximately 64 (sixty four) inch diameter (tip-to-tip fan diameter) or greater for enhancing air moving efficiency at lower speeds than conventional fans.

The twelfth objective of the subject invention is to provide efficient traditionally appearing ceiling fan blades, devices, apparatus and methods of operating ceiling fans, that can move air over large coverage areas compared to conventional flat appearing ceiling fan blades.

A preferred embodiment can include a plurality of efficient traditionally appearing ceiling fan blades, attached a ceiling fan motor. Diameter sizes of the fans can include but not be limited to less than and up to approximately 32", 48", 52", 54", 56", 60", 64", and greater. The blades can be made from wood, plastic, and the like, and can include separately attachable upper aerodynamic surfaces.

A preferred embodiment of the high efficiency traditional appearing ceiling fan can include a hub with a motor, and a plurality of blades attached to the ceiling fan motor, each blade having a flat and planar lower surfaces that visually appear to be flat and planar when viewed underneath the fan, and aerodynamic upper surfaces, wherein the aerodynamic upper surfaces of the blades move greater amounts of air compared to blades having both upper and lower flat and planar surfaces. Each of the blades can have tip ends being wider than root ends that are adjacent to the motor. The tip ends of the blades can have a width of approximately 5 to approximately 6 inches wide, and the root ends of the blades have a width of approximately 4 to approximately 5 inches wide. More preferably, the tip ends of the blades can have a width of approximately 5¾ inches wide, and the root ends of the blades have a width of approximately 4¾ inches wide. Each of the blades can have a rounded leading edge, and a blunt tipped trailing edge.

The upper surfaces of the blades can include a downwardly curving slope from the maximum thickness point to the blunt tipped trailing edge, and a mid-thickness along a longitudinal axis of the blade being thicker than both thicknesses along the leading edge and the trailing edge of the blades. The blades can be formed from molded plastic.

The aerodynamic upper surfaces can be made as part of the blades. Alternatively, the aerodynamic upper surfaces can be preformed and separately attachable to a base ceiling fan blade, the base ceiling fan blade having both upper and lower flat and planar surfaces.

A novel method of operating efficient traditionally appearing ceiling fan blades with aerodynamical upper surfaces ceiling fan, can include the steps of providing blades having a flat and planar lower surfaces that visually appear to be flat and planar when viewed underneath, and aerodynamic upper surfaces, the blades being attached to a ceiling fan motor, rotating the blades relative to the motor, and generating a CFM (cubic feet per minute) airflow of at least five (5) percent (%) greater than traditionally appearing ceiling fan blades that have both upper and lower flat and planar surfaces.

The method can further include the step generating an airflow of at least approximately 5% or greater CFM at a low rotational speed of approximately 0.15 meters per second (m/s) to approximately 0.40 meters per second (m/s) that is greater than the traditionally appearing ceiling fan blades that have both upper and lower flat and planar surfaces.

The method can include the step of generating an airflow of at least approximately 8% or greater CFM at a low rotational speed of approximately 0.15 meters per second (m/s) to approximately 0.40 meters per second (m/s) that is greater than the traditionally appearing ceiling fan blades that have both upper and lower flat and planar surfaces.

The method can include the step of generating an airflow of at least approximately 10% or greater CFM at a high rotational speed of approximately 0.50 meters per second (m/s) to approximately 0.85 meters per second (m/s) that is greater than the traditionally appearing ceiling fan blades that have both upper and lower flat and planar surfaces.

The method can include the step of generating an airflow of at least approximately 20% or greater CFM at a high rotational speed of approximately 0.50 meters per second (m/s) to approximately 0.85 meters per second (m/s) that is greater than the traditionally appearing ceiling fan blades that have both upper and lower flat and planar surfaces.

The method can include the step of generating an airflow of at least approximately 25% or greater CFM at a high rotational speed of approximately 0.50 meters per second (m/s) to approximately 0.85 meters per second (m/s) that is greater than the traditionally appearing ceiling fan blades that have both upper and lower flat and planar surfaces.

The method can include the step of generating an airflow of at least approximately 2,250 or greater total CFM (cubic feet per minute) below the rotating blades at a low rotational speed of approximately 0.15 meters per second (m/s) to approximately 0.40 meters per second (m/s). The method can further include the step of generating an airflow of at least approximately 2,500 or greater total CFM (cubic feet per minute) below the rotating blades at a low rotational speed of approximately 0.15 meters per second (m/s) to approximately 0.40 meters per second (m/s).

The method can include the step of generating an airflow of at least approximately 2,700 or greater total CFM (cubic feet per minute) below the rotating blades at a low rotational speed of approximately 0.15 meters per second (m/s) to approximately 0.40 meters per second (m/s).

The method can include the step of generating an airflow of at least approximately 5,900 or greater total CFM (cubic feet per minute) below the rotating blades at a high rotational speed of approximately 0.50 meters per second (m/s) to approximately 0.85 meters per second (m/s).

The method can include the step of generating an airflow of at least approximately 6,000 or greater total CFM (cubic feet per minute) below the rotating blades at a high rotational speed of approximately 0.50 meters per second (m/s) to approximately 0.85 meters per second (m/s).

The method can include the step of generating an airflow of at least approximately 6,300 or greater total CFM (cubic feet per minute) below the rotating blades at a high rotational speed of approximately 0.50 meters per second (m/s) to approximately 0.85 meters per second (m/s).

The method can include the step of generating at least approximately 160 or greater total CFM (cubic feet per minute) per Watts below the rotating blades at a low rotational speed of approximately 0.15 meters per second (m/s) to approximately 0.40 meters per second (m/s).

The method can include the step of generating at least approximately 175 or greater total CFM (cubic feet per minute) per Watts below the rotating blades at a low rotational speed of approximately 0.15 meters per second (m/s) to approximately 0.40 meters per second (m/s).

The method can include the step of generating at least approximately 189 or greater total CFM (cubic feet per minute) per Watts below the rotating blades at a low rotational speed of approximately 0.15 meters per second (m/s) to approximately 0.40 meters per second (m/s).

The method can include the step of generating at least approximately 100 or greater total CFM (cubic feet per minute) per Watts below the rotating blades at a high rotational speed of approximately 0.50 meters per second (m/s) to approximately 0.85 meters per second (m/s).

Further objects and advantages of this invention will be apparent from the following detailed descriptions of the presently preferred embodiments which are illustrated schematically in the accompanying drawings.

BRIEF DESCRIPTION OF THE FIGURES

First Embodiment Small Diameter Blades

Second Embodiment Large Diameter Blades

Figure 5:
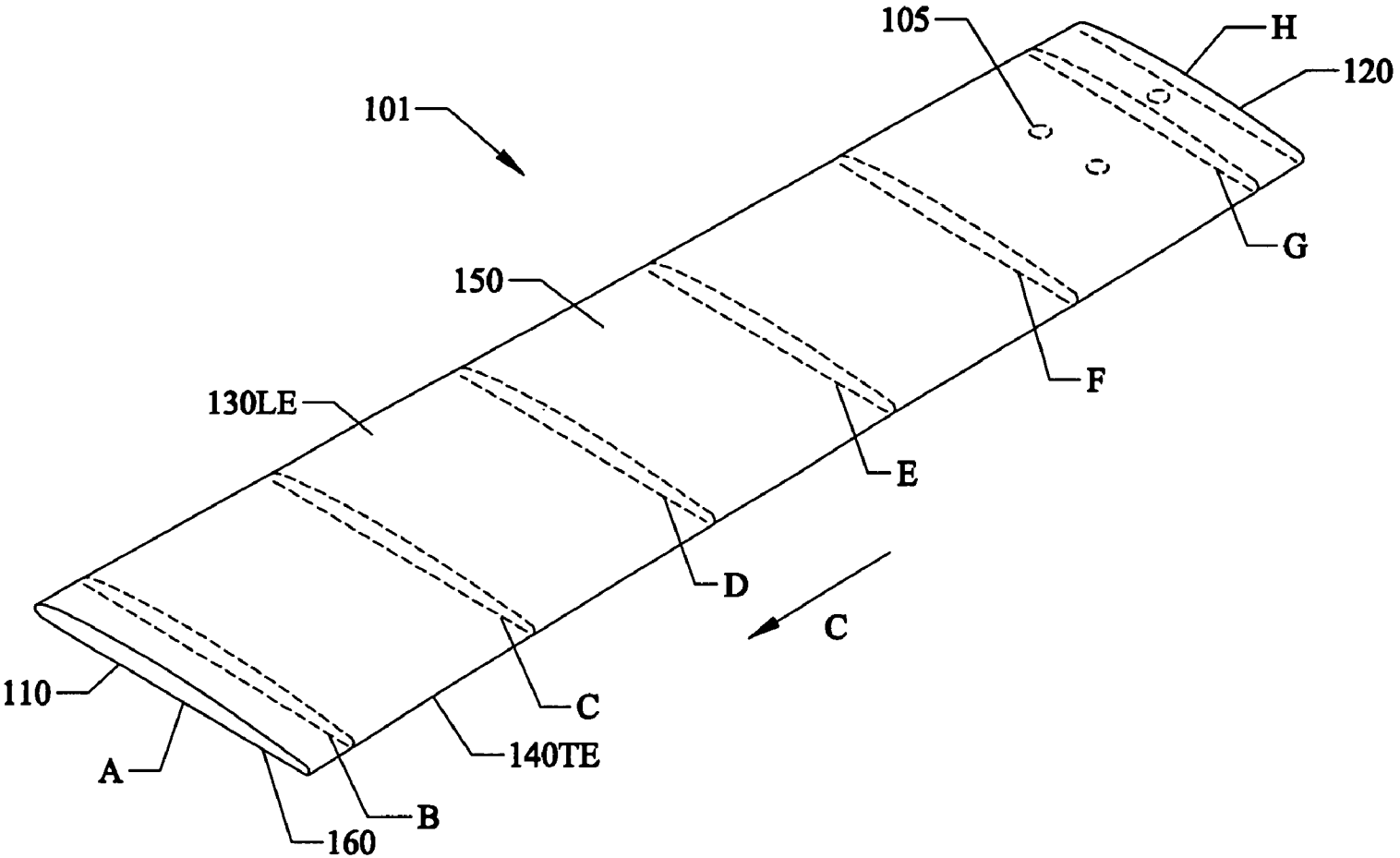

FIG. 5 is a top perspective view of a second embodiment of a large efficient traditionally appearing ceiling fan blade with aerodynamical upper surfaces and wide tip end with labeled cross-sections A, B, C, D, E, F, G, H.

Figure 6:
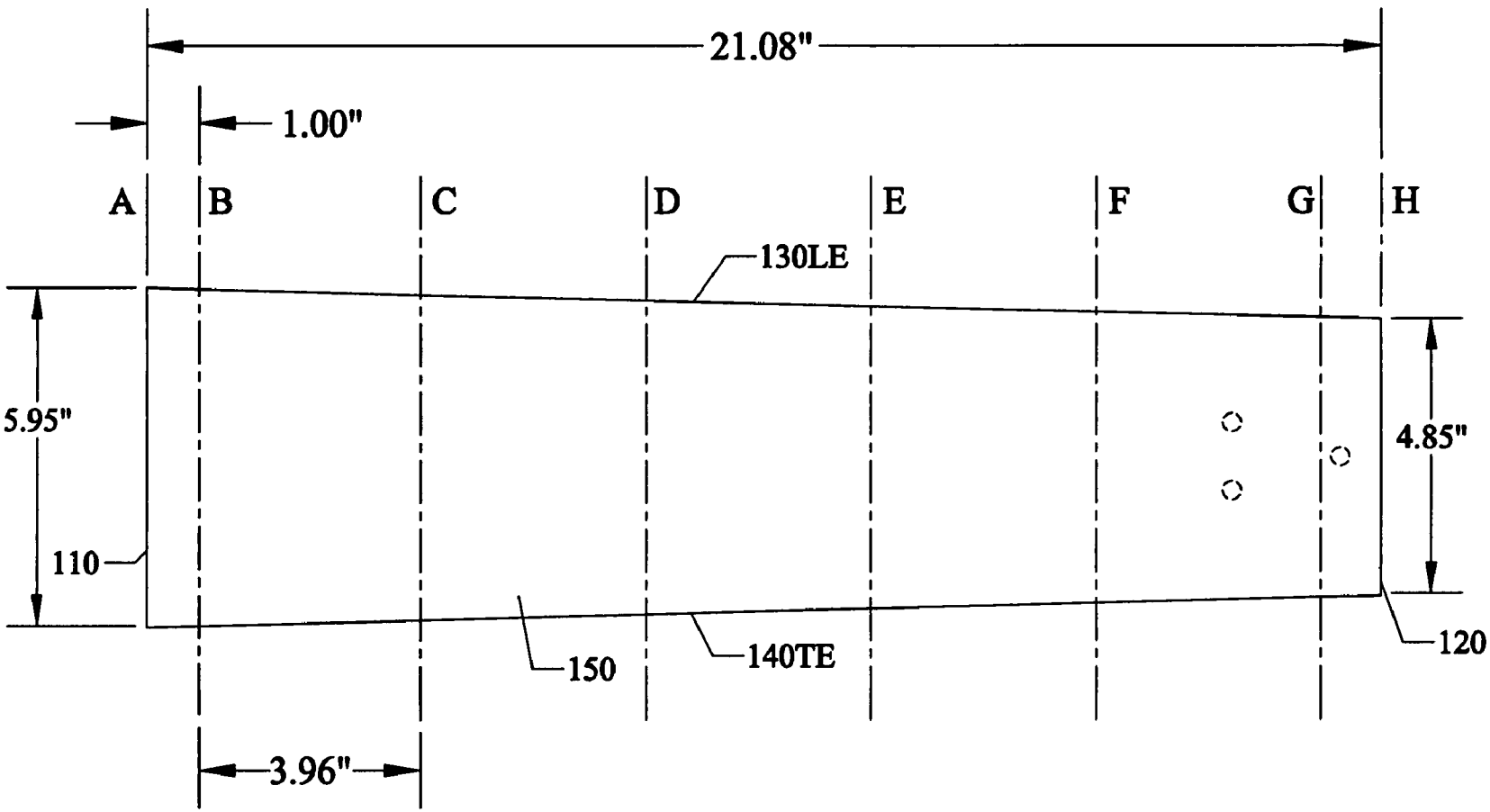

FIG. 6 is a top view of the large efficient traditionally appearing ceiling fan blade with aerodynamical upper surfaces of FIG. 5 with labeled cross-sections A-H.

Figure 7A:
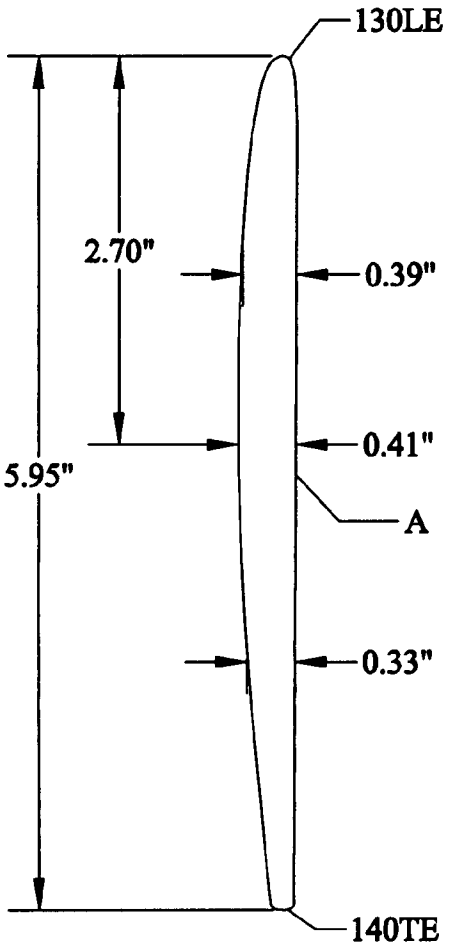

FIG. 7A shows the cross-section A of FIGS. 5-6.

Figure 7B:
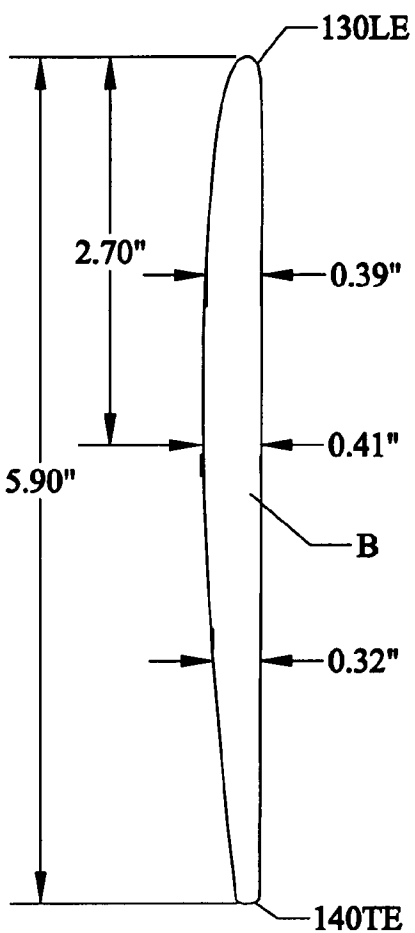

FIG. 7B shows the cross-section B of FIGS. 5-6.

Figure 7C:
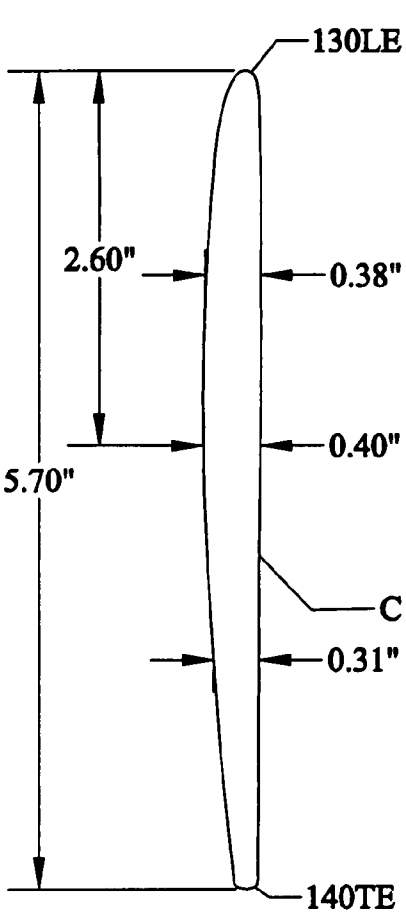

FIG. 7C shows the cross-section C of FIGS. 5-6.

Figure 7F:
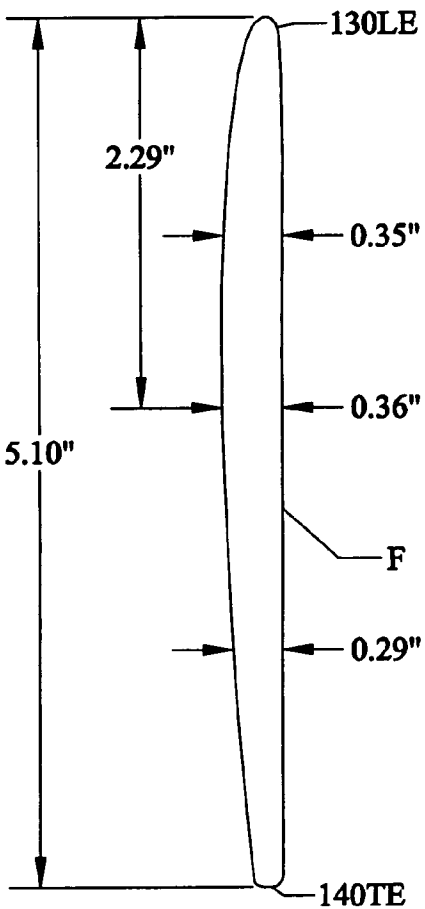
Figure 7E:
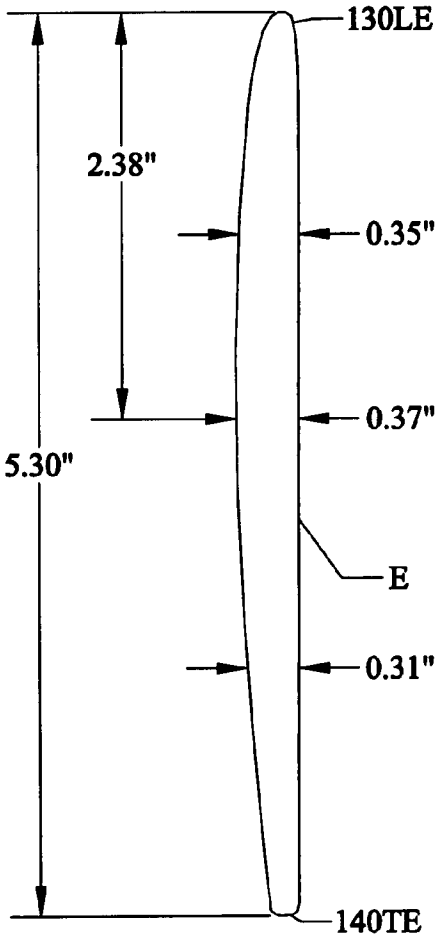
Figure 7D:
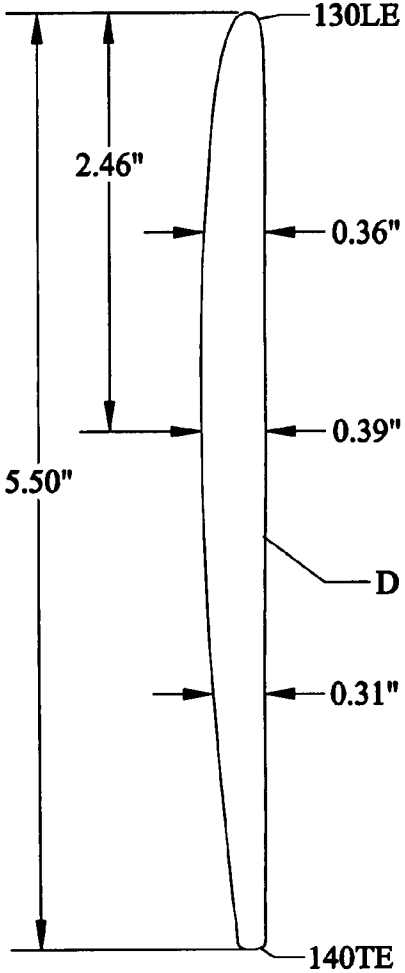

FIG. 7D shows the cross-section D of FIGS. 5-6.

FIG. 7E shows the cross-section E of FIGS. 5-6.

FIG. 7F shows the cross-section F of FIGS. 5-6.

Figure 7H:
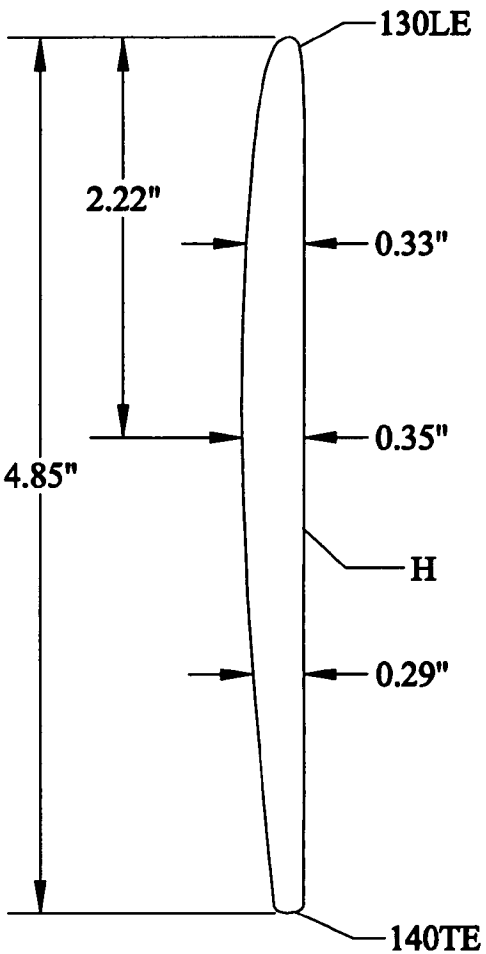
Figure 7G:
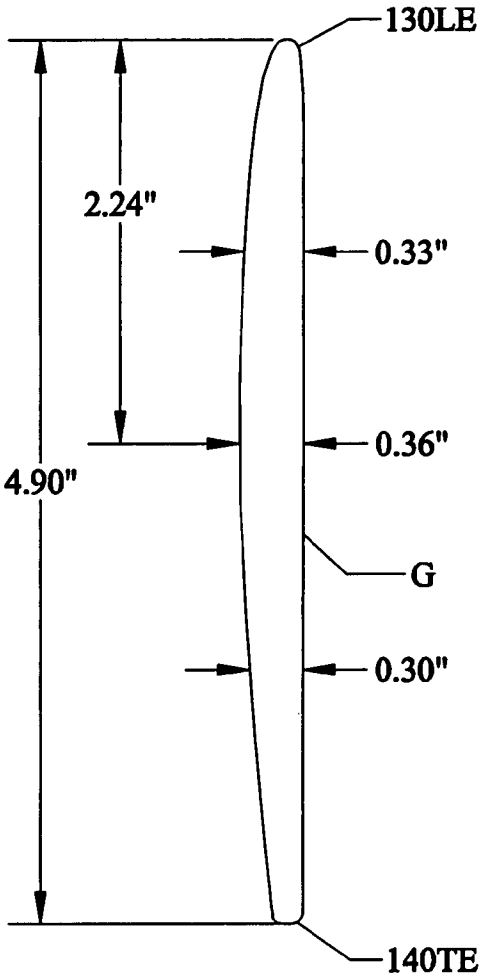

FIG. 7G shows the cross-section G of FIGS. 5-6.

FIG. 7H shows the cross-section H of FIGS. 5-6.

Figure 8A:
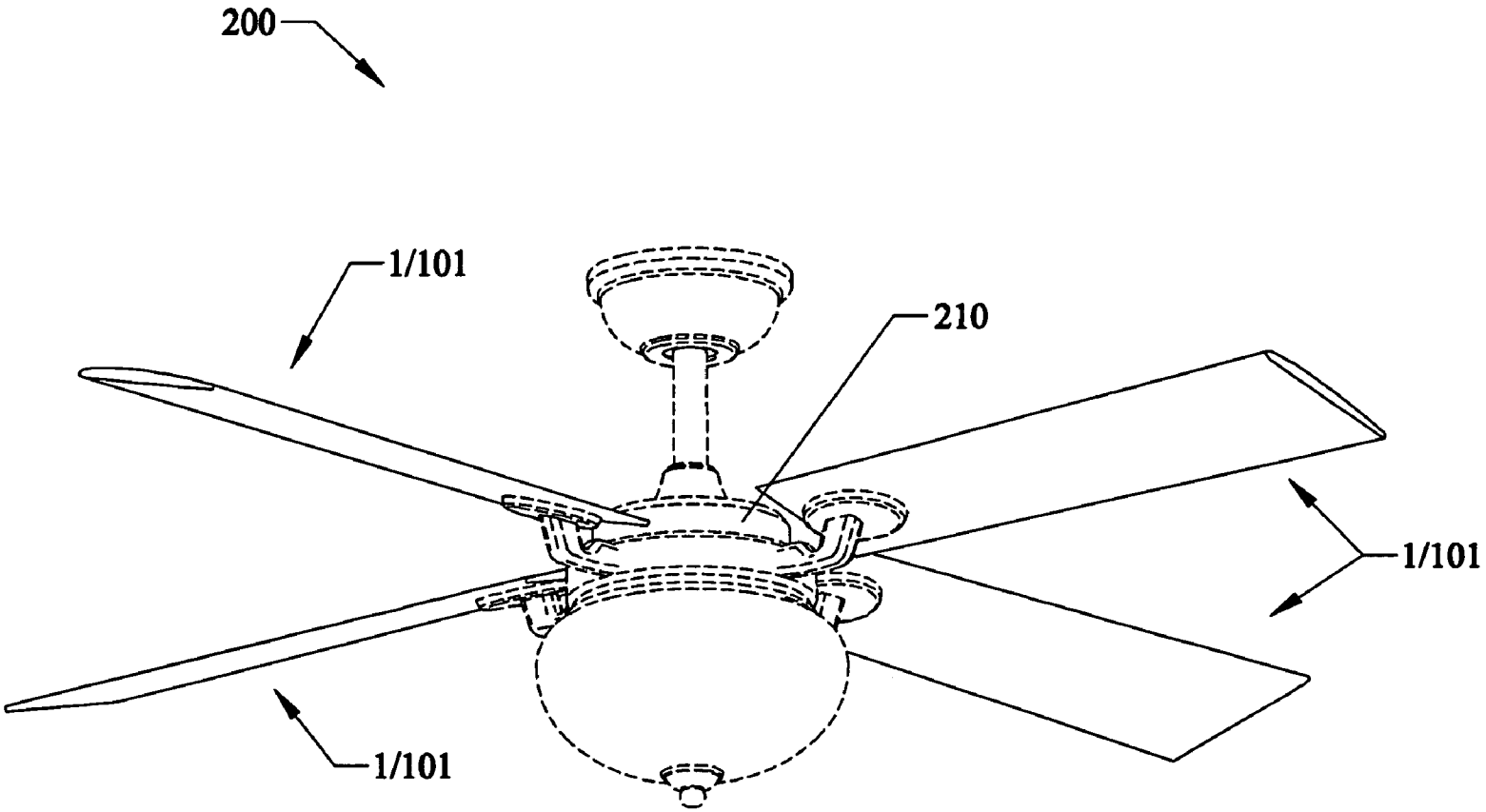

FIG. 8A is a perspective bottom view of a ceiling fan and efficient blades of FIGS. 1-71

Figure 8B:
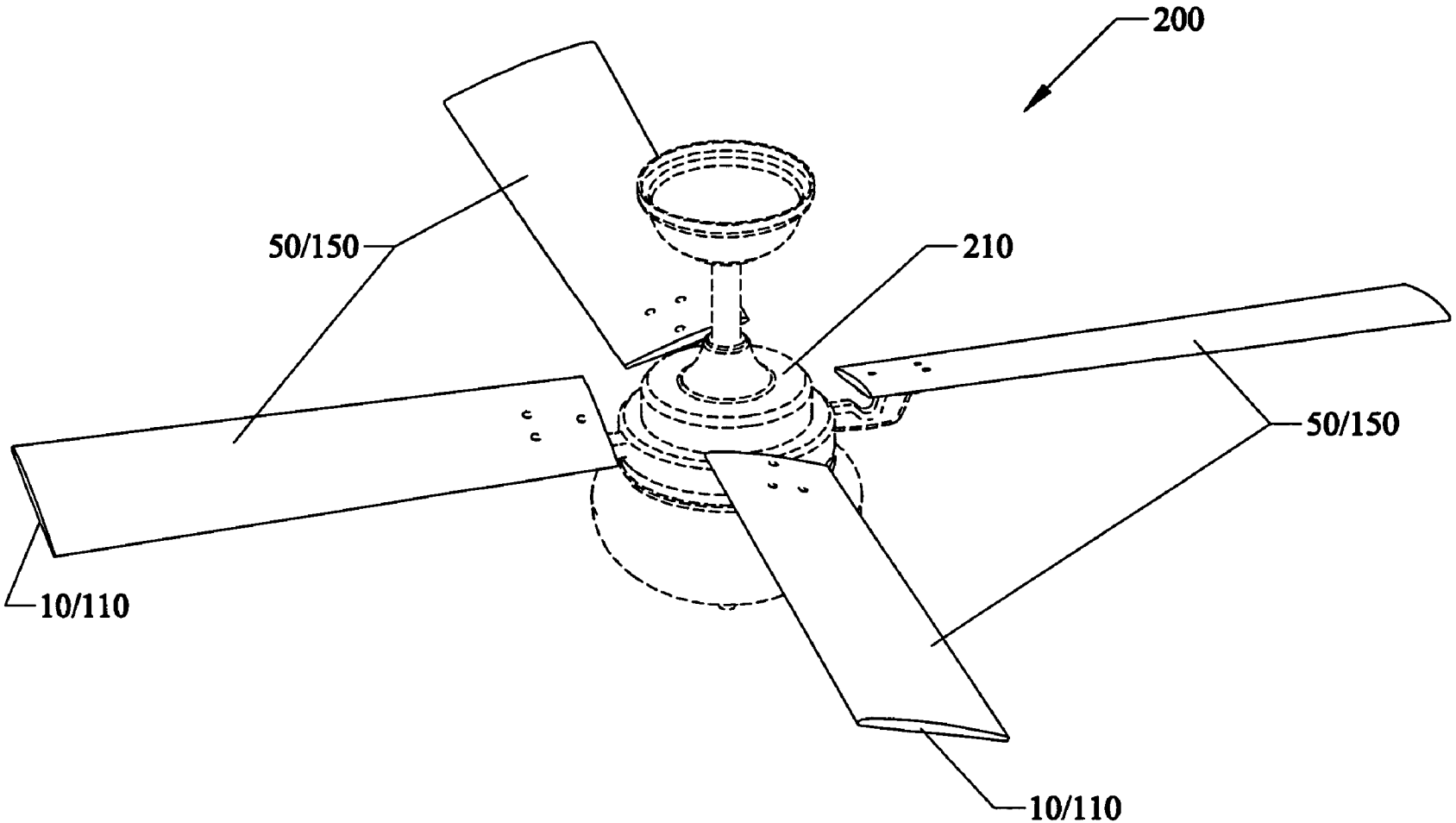

FIG. 8B is a perspective top view of the ceiling fan and efficient blades of FIG. 8A.

Figure 8C:
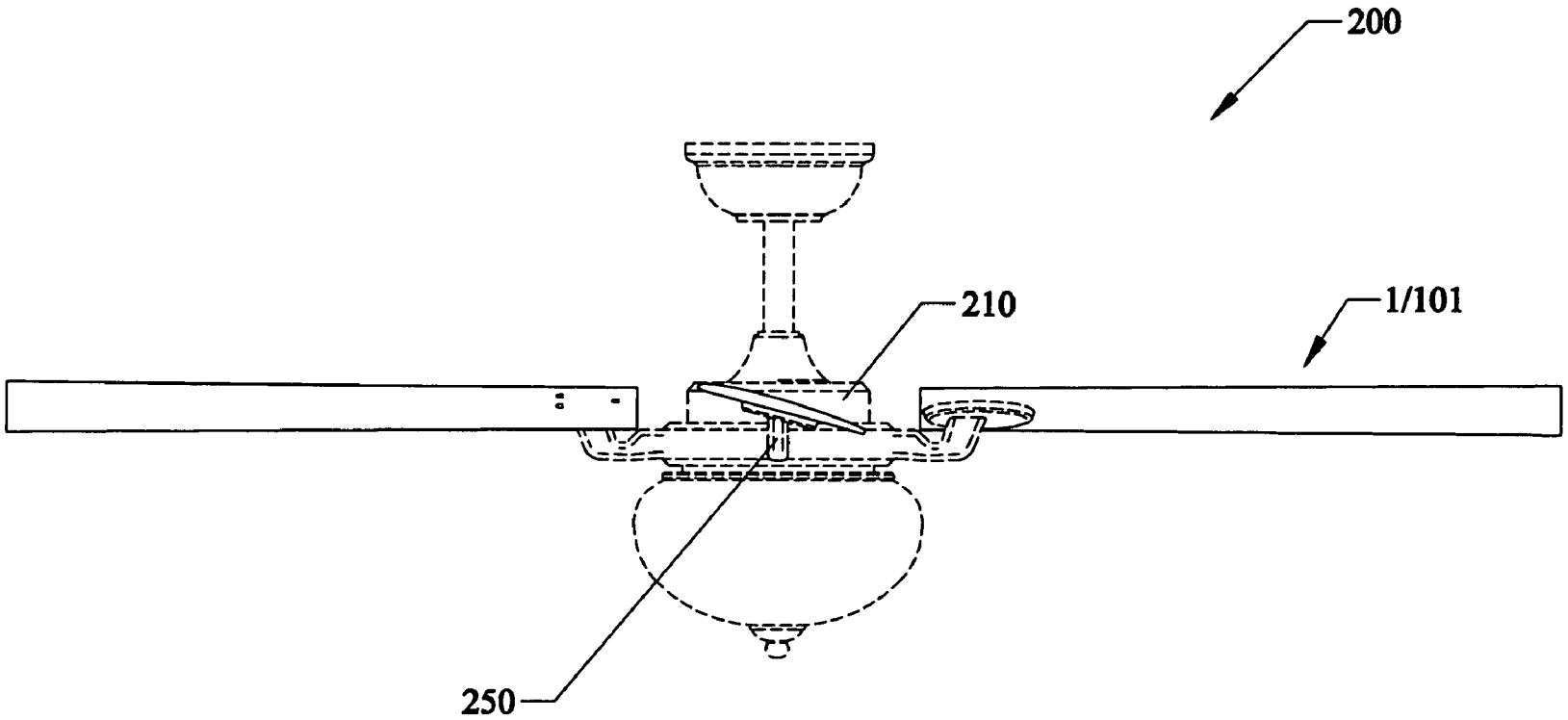

FIG. 8C is a side perspective view of the ceiling fan and efficient blades of FIG. 8A.

Figure 8D:
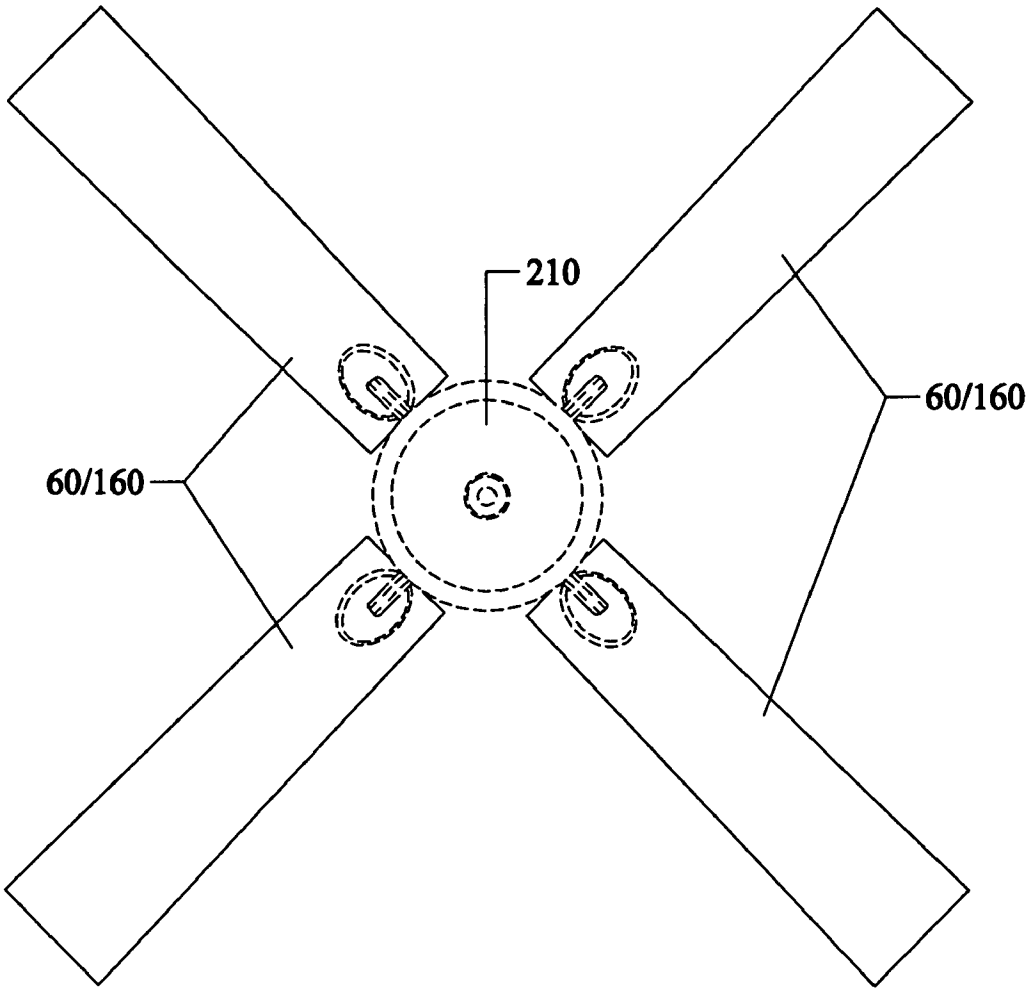

FIG. 8D is a bottom view of the ceiling fan and efficient blades of FIG. 8A.

Figure 8E:
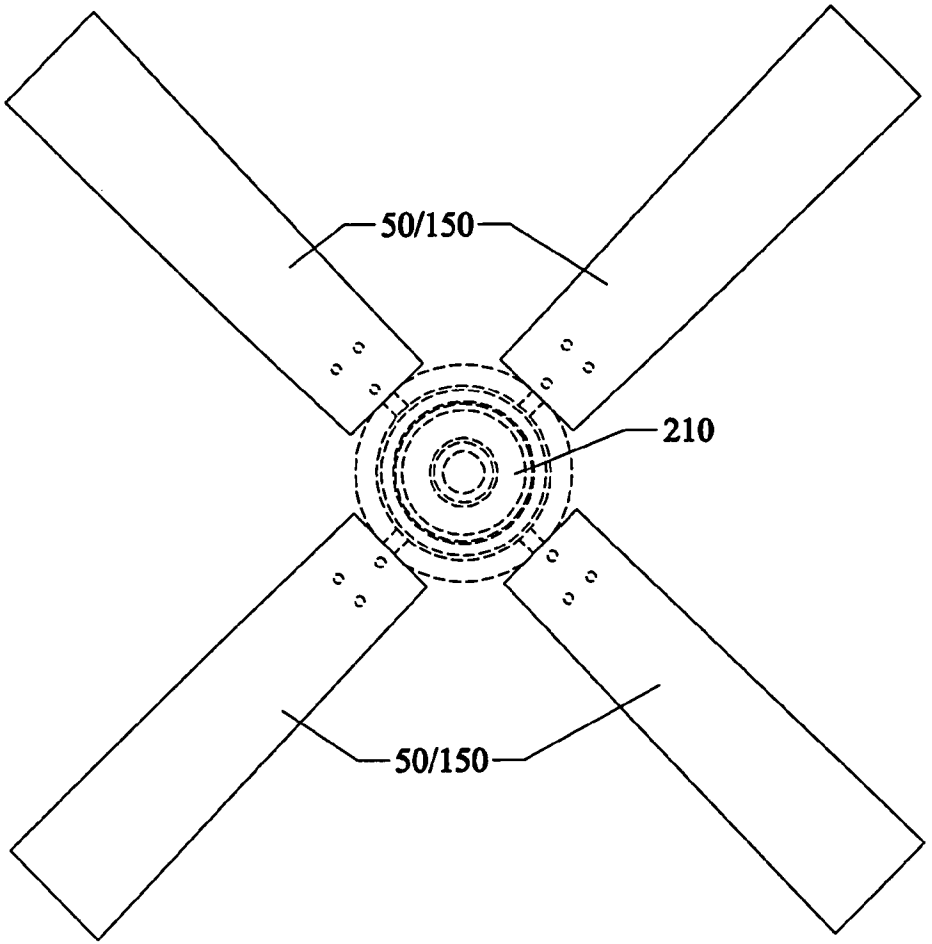

FIG. 8E is a top view of the ceiling fan and efficient blades of FIG. 8A.

Third Embodiment Rounded Wide Tip End Blades

Figure 9A:
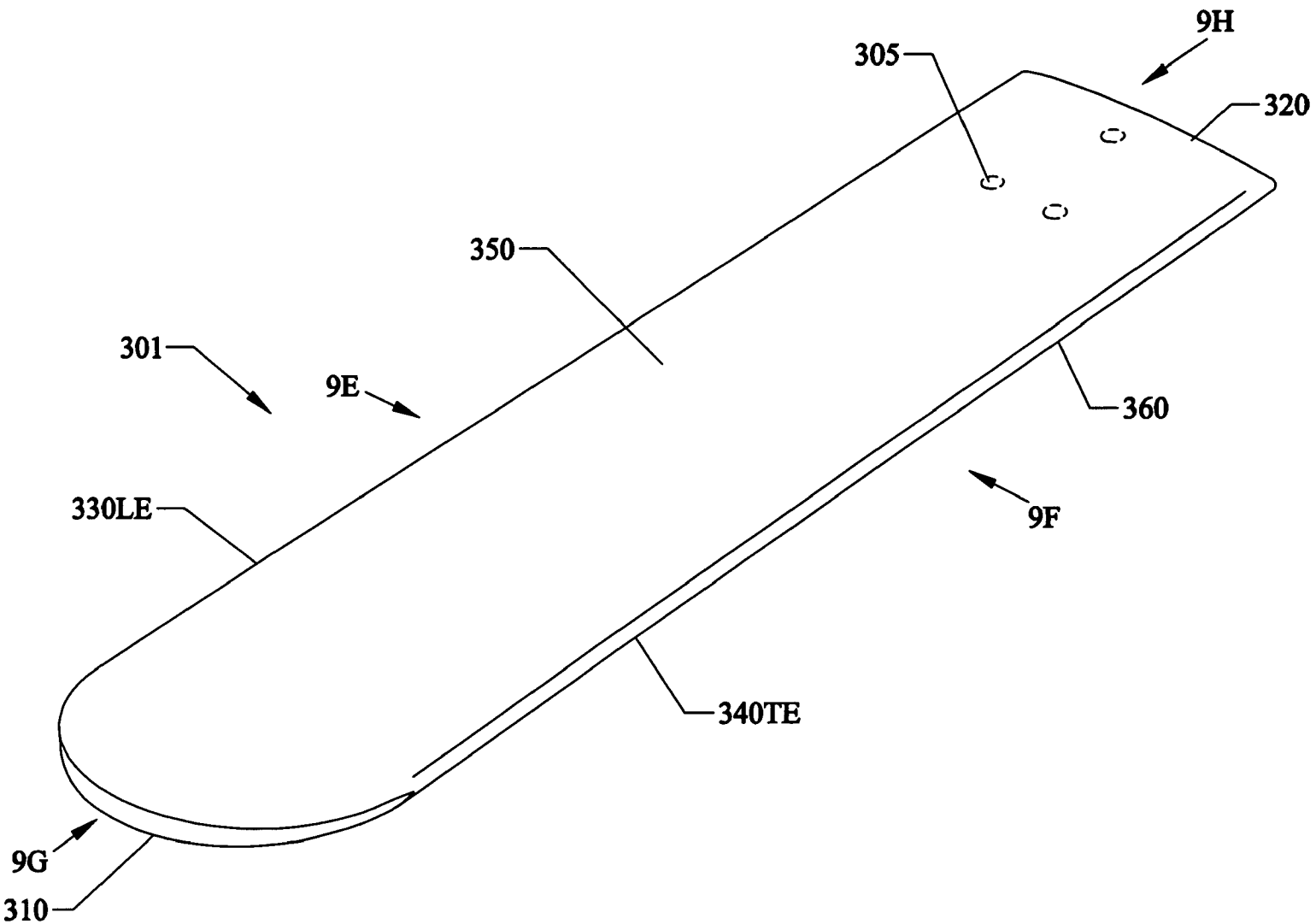

FIG. 9A is a top perspective view of a third embodiment efficient traditionally appearing ceiling fan blade with aerodynamical upper surfaces and rounded wide tip end.

Figure 9B:
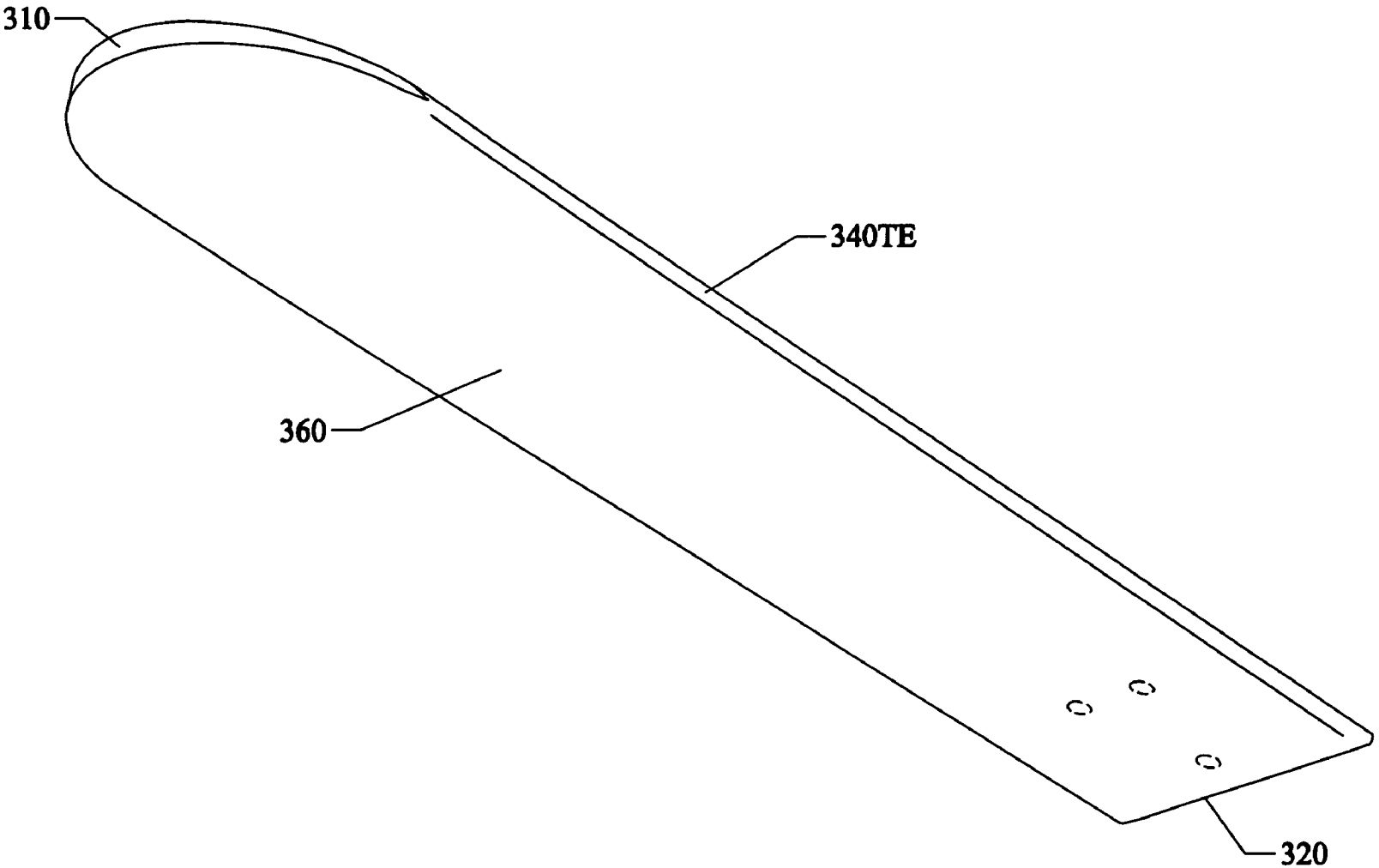

FIG. 9B is a bottom perspective view of the blade of FIG. 9A.

Figure 9C:
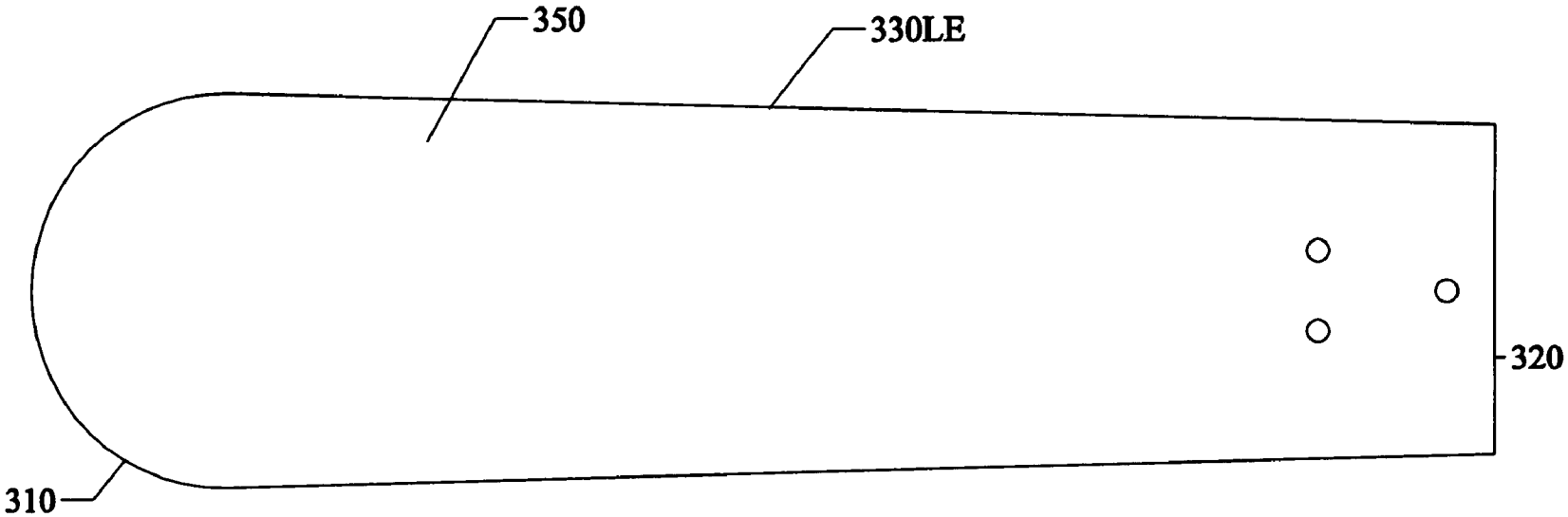

FIG. 9C is a top planar view of the blade of FIG. 9A.

Figure 9D:
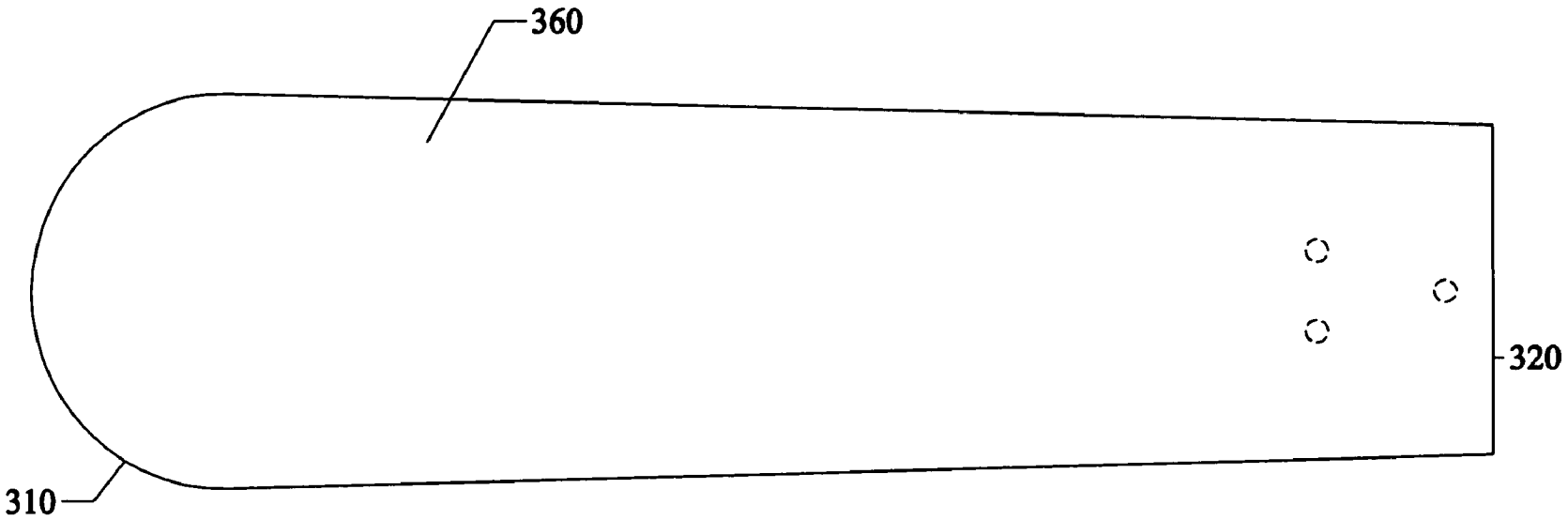

FIG. 9D is a bottom planar view of the blade of FIG. 9A.

Figure 9F:
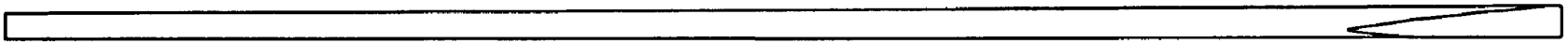
Figure 9E:
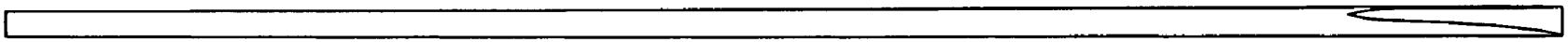

FIG. 9E is a left side view of the blade of FIG. 9A along arrow 9E.

FIG. 9F is a right side view of the blade of FIG. 9A along arrow 9F.

Figure 9G:
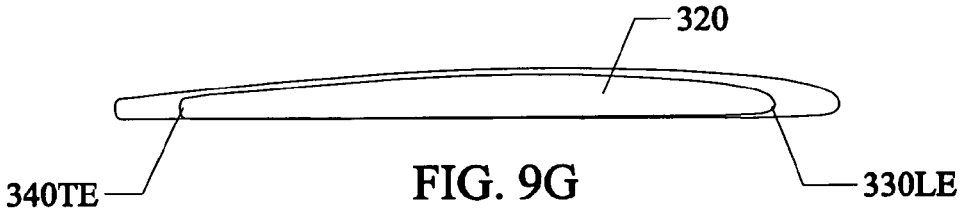

FIG. 9G is a tip end view of the blade of FIG. 9A along arrow 9G.

Figure 9H:
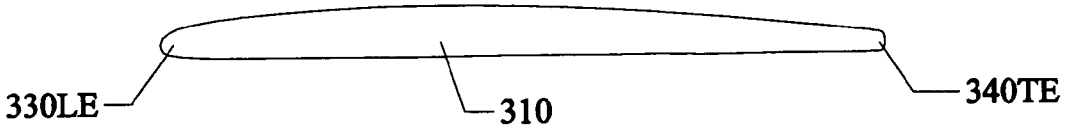

FIG. 9H is a root end view of the blade of FIG. 9A along arrow 9H.

Fourth Embodiment Curved Wide Tip End Blades

Figure 10A:
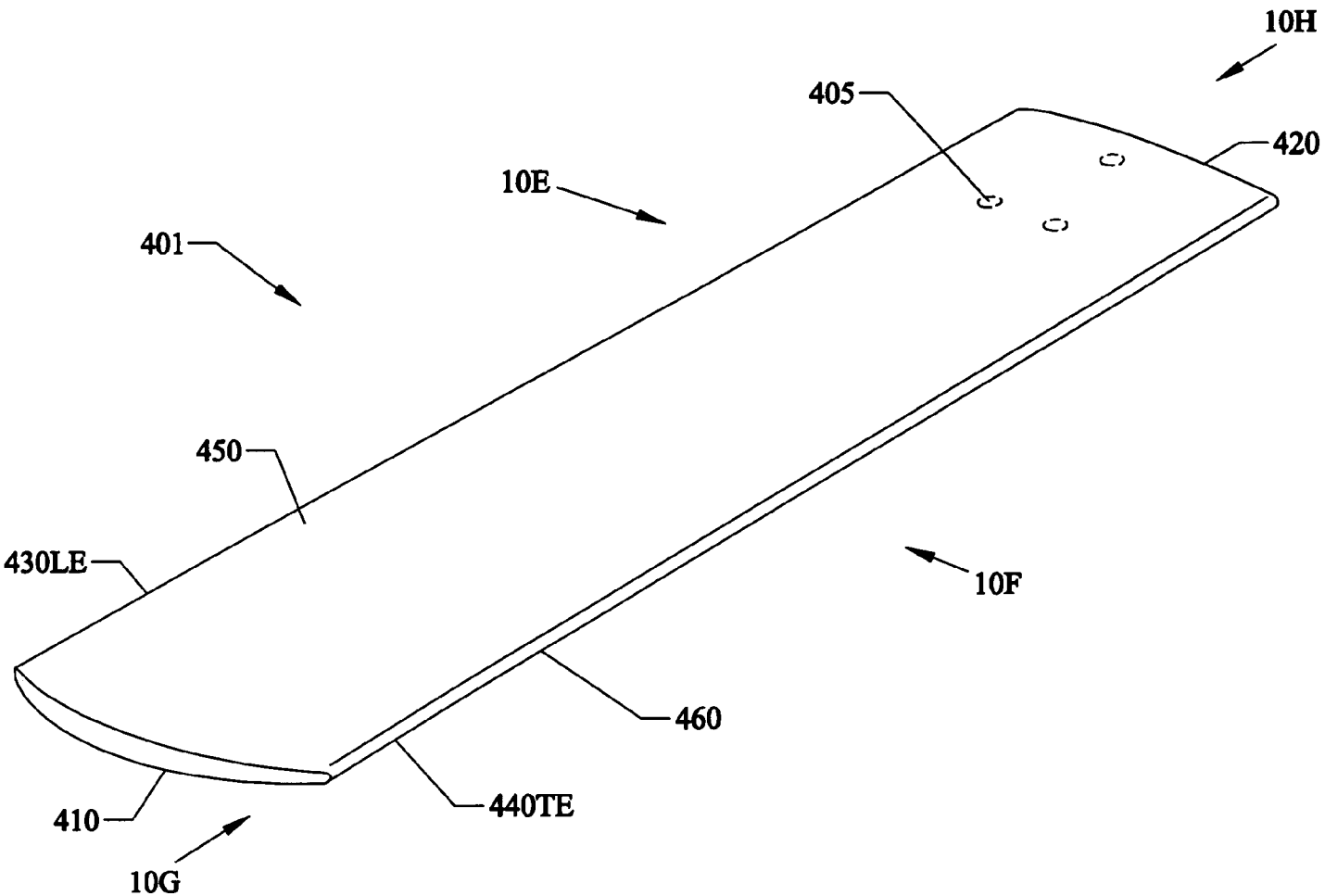

FIG. 10A is a top perspective view of a fourth embodiment efficient traditionally appearing ceiling fan blade with aerodynamical upper surfaces and curved wide tip end.

Figure 10B:
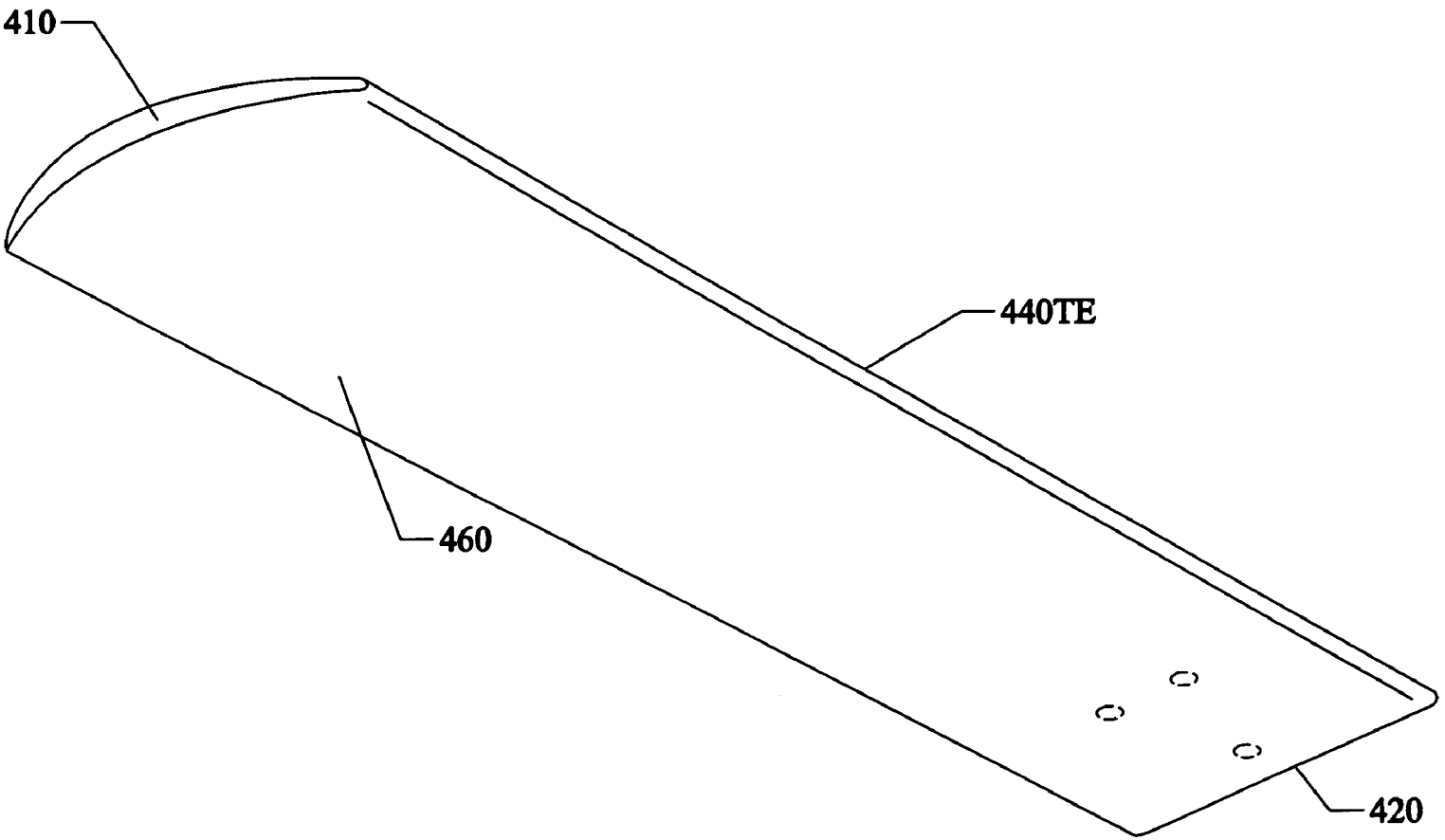

FIG. 10B is a bottom perspective view of the blade of FIG. 10A.

Figure 10C:
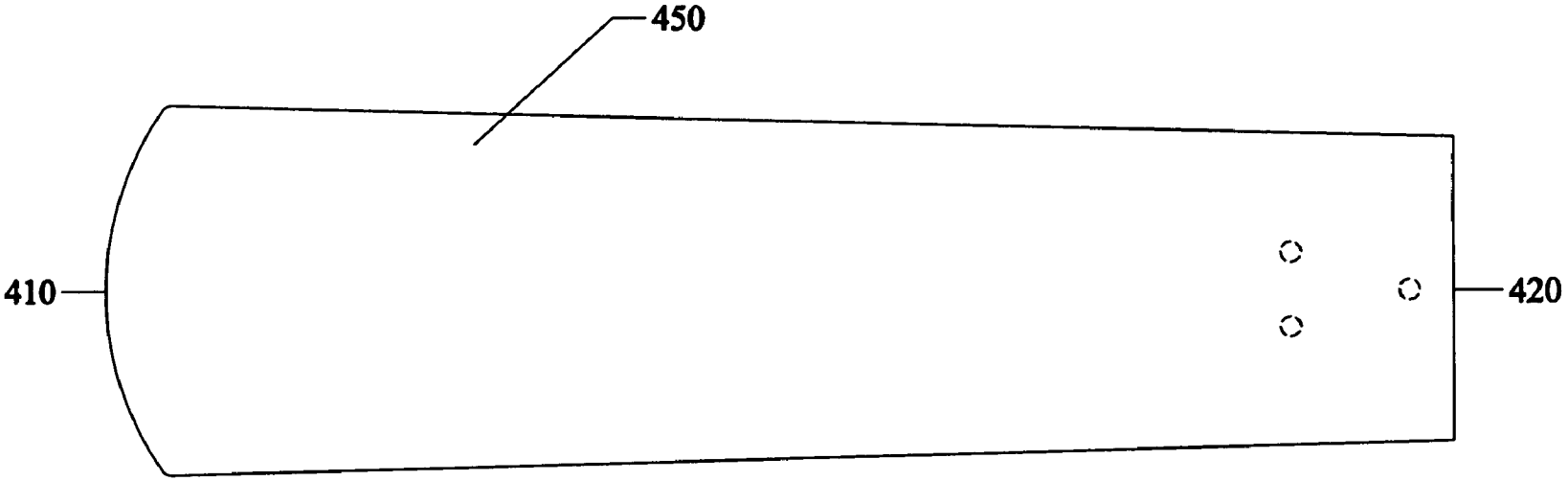

FIG. 10C is a top planar view of the blade of FIG. 10A.

Figure 10D:
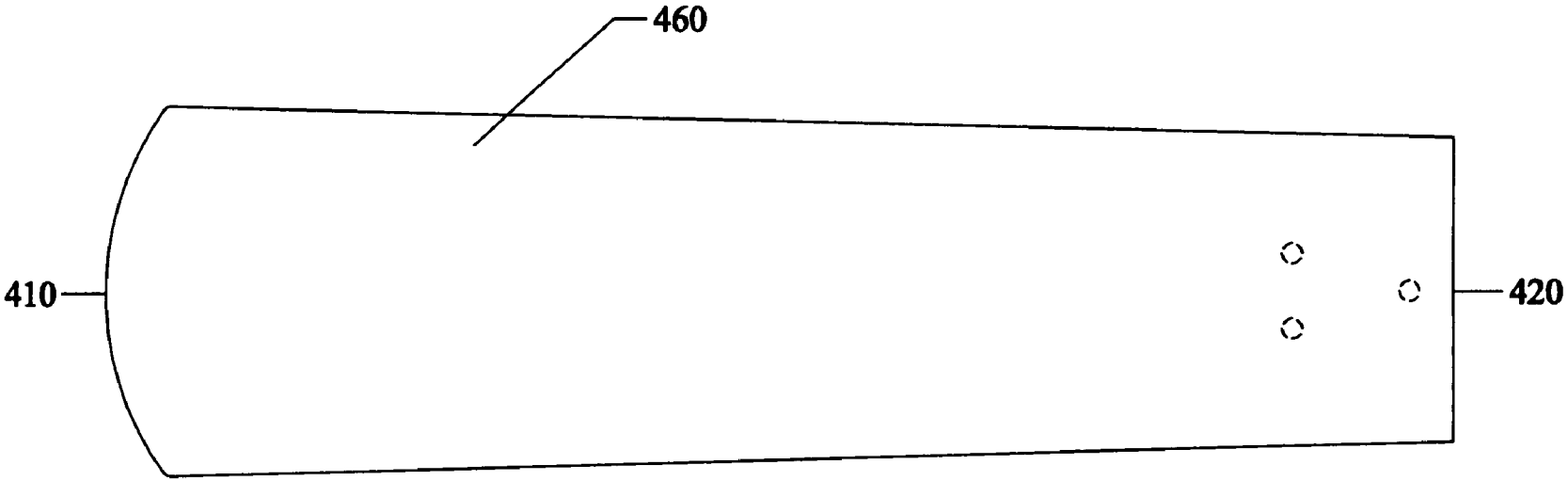

FIG. 10D is a bottom planar view of the blade of FIG. 10A.

Figure 10F:
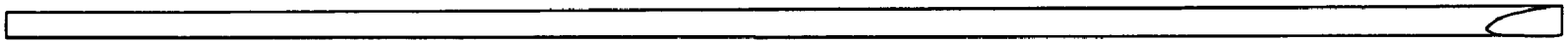
Figure 10E:
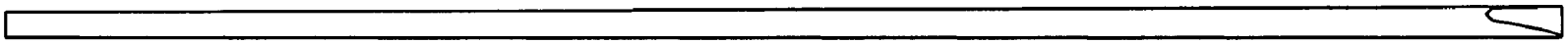

FIG. 10E is a left side view of the blade of FIG. 10A along arrow 10E.

FIG. 10F is a right side view of the blade of FIG. 10A along arrow 10F.

Figure 10G:
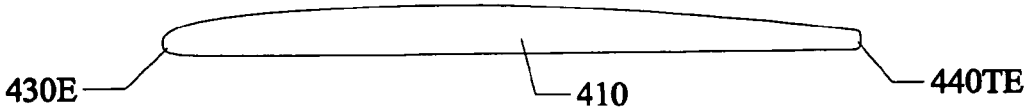

FIG. 10G is a tip end view of the blade of FIG. 10A along arrow 10G.

Figure 10H:
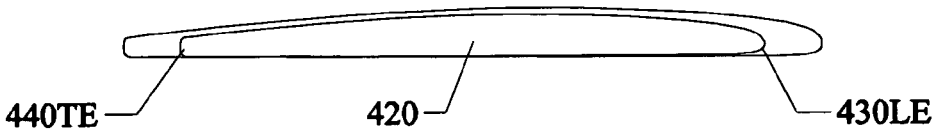

FIG. 10H is a root end view of the blade of FIG. 10A along arrow 10H.

Fifth Embodiment Separately Attachable Aerodynamic Surface

Figure 11:
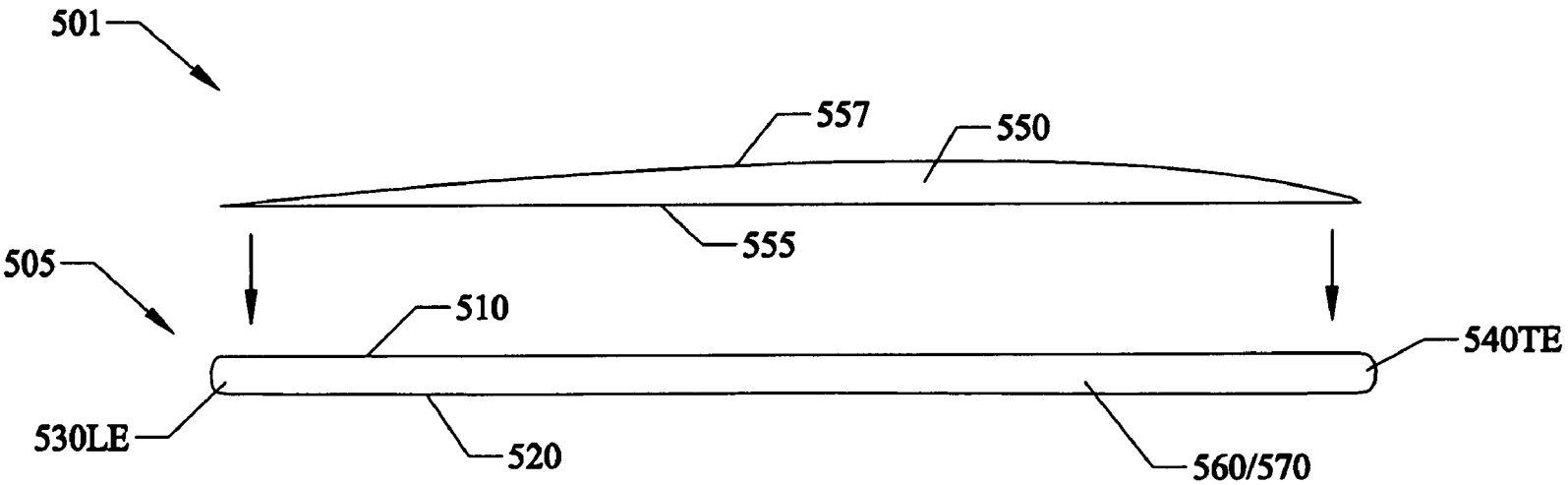

FIG. 11 is tip end exploded view of a separate attachable aerodynamic surface that can be attached to conventional flat-planar surface ceiling fan blades.

Figure 12:
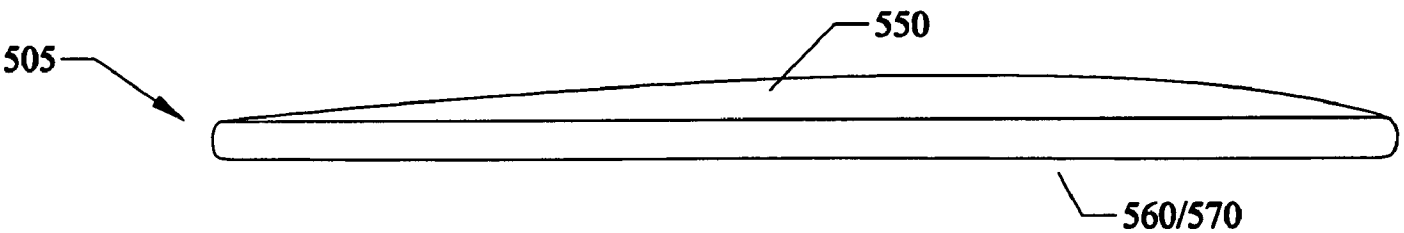

FIG. 12 is another view of FIG. 11 with the aerodynamic surface attached to the blade.

Figure 13:
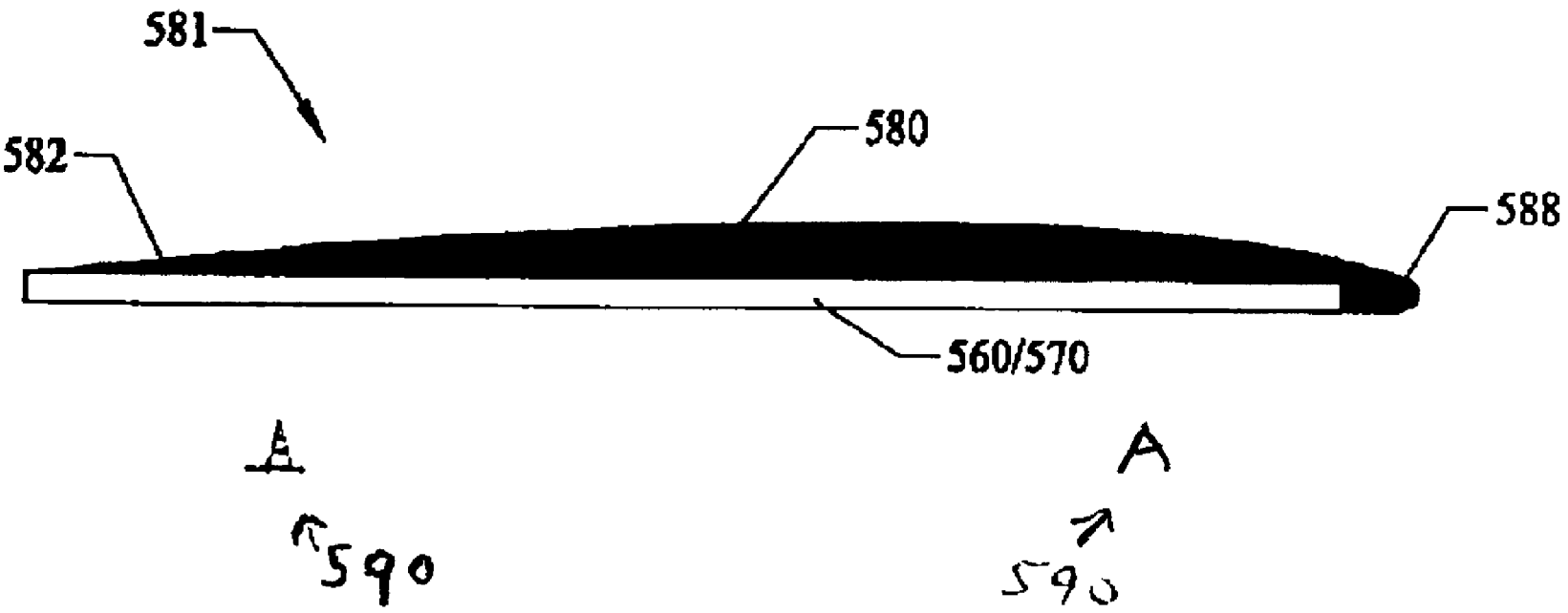

FIG. 13 is another version of the separately attachable aerodynamic surface with blade.

DESCRIPTION OF THE PREFERRED EMBODIMENT

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

The subject invention is a Continuation-In-Part of Design application Ser. No. 29/252,288 filed Jan. 20, 2006, which is incorporated by reference.

Testing of novel ceiling fan blades were conducted in July-August 2005, and included three parameters of measurement data: airflow (meters per second (m/s), power (in watts) and speed (revolutions per minute (rpm)). Those novel ceiling fan blades far surpassed the operating performance of various traditional flat planar ceiling fans in operation.

The tested blade had a reverse taper as compared to conventional blades. The tested blade was wider at the tip than the root. The first one tested had a flat bottom, a pitch of approximately 10 to approximately 12 degrees and an air foil (aerodynamic upper surface) on top (the upper surface). It is essentially a flat ceiling fan blade with an engineered air foil. We tested these by running an evaluation of a Huntington III in our lab and then changing to the new blades with the air foil on top. The short of the attached test results is that air flow was increased by approximately 10% at high speed to over approximately 26% at low speed. Again, this innovation is potentially revolutionary relative to reaching the EnergyStar designation with standard ceiling fans which is described below in relation to Table 5.

While the novel blades look completely conventional when viewed from underneath, the novel blades perform considerably better relative to their air moving efficiency. Another test gave the novel blade a very slight twist.

The modified blade is intended to move more air than the flat paddle blade, with the same input power. The aerodynamic upper surfaces allow the blade to work efficiently at both higher and lower RPM (revolutions per minute). To work effectively at lower RPM the blades can also be set at a higher pitch. The mounting brackets on the modified set of blades can be set to either a higher or lower pitch setting.

The motor efficiency was expected to change with RPM. The modified aerodynamic blades were expected to work best in conjunction with a motor that has good efficiency at slower RPM.

To separate the effects of aerodynamics and electrical motor performance a dynamometer set up was used for the testing procedures. A dynamometer measures torque and RPM. A torque sensor can be used where the motor mounts to the ceiling. With no other torques on the motor, the torque on the mount is the same as the torque on the turning shaft. The mechanical power going from the motor to the fan is equal to the torque times the RPM times a constant factor.

In English units the torque in foot-lbs times the rotational speed in radians/second is the power in foot-lbs/second. In metric units the torque in newton-meters times the rotational speed in radians/second equals the power in watts. To convert RPM into radians/second, and rad/sec=2 PI×RPM/60.

Laboratory tests were conducted on a standard ceiling fan with flat planar blades such as a 52" Diameter Huntington III from Hampton Bay, which is sold by Home Depot, and the 52" Hunter Silent(S) Breeze from Hunter Fan Company and compared against the novel efficient traditionally appearing ceiling fan blades, having aerodynamical upper surfaces.

The novel efficient aerodynamic blades tested had dimensions of those described in reference to FIGS. 1A-1G below, where the blades had an overall length between root end 20 and tip end 10 of approximately 20 inches, where the root end can have a diameter of approximately 3.53 inches that widens outward along blade 1 to the tip end that can have a diameter of approximately 4.53 inches.

Measurements were taken in an environmental chamber under controlled conditions using solid state measurement methods recommended by the United States Environmental Protection Agency in their Energy Star Ceiling Fan program which used a hot wire anemometer which required a temperature controlled room and a computer for testing data.

http://www.energystar.gov/ia/partners/prod_development/revisions/downloads/ceil_fans/final.pdf In the tables below, air flow in CFM stands for cubic feet per minute, and power is measured in Watts (W).

The tested aerodynamic novel efficient fan blades had an overall diameter of approximately 52 inches across five blades, powered by a triple capacitor Powermax 188 mm by 155 mm motor. The low speed RPM (revolutions per minute) of the HUNTINGTON III was approximately 88 RPM. The low speed of the HUNTER S BREEZE was approximately 55 RPM. The low speed of the EFFICIENT NOVEL BLADES was approximately 104 RPM.

The data yielded the following improvements in Tables 1 and 2 at Low Speed of the Huntington III and the Hunter S Breeze each running at approximately 55 to approximately 88 RPM (revolutions per minute) and the novel efficient blades having a low speed of approximately 104 RPM.

Table 1 indicates the velocity measured (m/s) underneath a ceiling mounted fan with measurement location (feet from center) for the three fans (Huntington III, Hunter S. Breeze and Novel Efficient Blades) for low speed operation of the fans. The measurements were made approximately 56" inches above the floor, and a calibrated hot-wire anemometer was used to take the measurements.

TABLE 1

| Measurement Location | Velocity Measured (m/s) | | |
|---|---|---|---|
| (feet from center) | Huntington III | Hunter S. Breeze | Novel Efficient |
| 0 | 0.440 | 0.270 | 0.820 |
| 0.5 | 0.270 | 0.240 | 0.910 |
| 1 | 0.420 | 0.370 | 0.990 |
| 1.5 | 0.520 | 0.480 | 0.780 |
| 2 | 0.510 | 0.400 | 0.460 |
| 2.5 | 0.330 | 0.080 | 0.200 |
| 3 | 0.160 | 0.010 | 0.180 |
| 3.5 | 0.100 | 0.000 | 0.120 |
| 4 | 0.100 | 0.000 | 0.090 |
| 4.5 | 0.080 | 0.000 | 0.080 |
| 5 | 0.030 | 0.000 | 0.080 |
| 5.5 | 0.030 | 0.000 | 0.030 |

TABLE 2 provides the average velocity (m/s), total CFM (cubic feet per minute), total Watts (power usage), and total CFM/Watts for the three fans (Huntington III, Hunter S. Breeze and Novel Efficient Blades) for low speed operation.

TABLE 2

| Fan Type | Huntington III | Hunter S. Breeze | Novel Efficient |
|---|---|---|---|
| Average Velocity (m/s) | 0.25 | 0.15 | 0.40 |
| Total CFM | 2136.6 | 1396.1 | 2711.8 |
| Total Watts | 14.3 | 8.9 | 14.3 |
| Total CFM/Watts | 149.4 | 156.9 | 189.6 |

As shown in Table 1 at low speed, absolute flow (CFM) (2711.8/2136.6) was increased by approximately 26.9% with efficiency (189/149.4) improved by a similar amount of approximately 26.5% when comparing the novel efficient fan blades over the Huntington III fan.

Also, at low speed, absolute flow (CFM) (2711.8/1396.1) was increased by approximately 94% with efficiency (189/156.9) improved by approximately 20.45% when comparing the novel efficient fan blades over the Hunter S. Breeze fan.

For Table 3, the high speed for the HUNTINGTON III was approximately 216 RPM, the high speed for the HUNTER S BREEZE was approximately 165 RPM. The high speed for the EFFICIENT NOVEL BLADES was approximately 248 RPM.

Table 3 has data of High Speed of the Huntington III and the Hunter S Breeze each running at approximately 165 to approximately216 RPM (revolutions per minute) and the novel efficient blades having a low speed of approximately 248 RPM.

Table 3 indicates the velocity measured (m/s) underneath a ceiling mounted fan with measurement location (feet from center) for the three fans (Huntington III, Hunter S. Breeze and Novel Efficient Blades) for high speed operation of the fans.

TABLE 3

| Measurement Location (feet from center) | Velocity Measured (m/s) | | |
|---|---|---|---|
| | Huntington III | nter-Summer Breeze | Novel Efficient |
| 0 | 0.790 | 1.135 | 1.040 |
| 0.5 | 0.770 | 1.905 | 1.330 |
| 1 | 1.430 | 2.065 | 2.110 |
| 1.5 | 1.450 | 1.505 | 2.130 |
| 2 | 1.250 | 0.580 | 0.960 |
| 2.5 | 0.850 | 0.185 | 0.690 |
| 3 | 0.500 | 0.165 | 0.370 |
| 3.5 | 0.280 | 0.115 | 0.230 |
| 4 | 0.170 | 0.130 | 0.200 |
| 4.5 | 0.130 | 0.120 | 0.200 |
| 5 | 0.130 | 0.135 | 0.200 |
| 5.5 | 0.110 | 0.160 | 0.200 |

TABLE 4 provides the average velocity (m/s), total CFM (cubic feet per minute), total Watts (power usage), and total CFM/Watts for the three fans (Huntington III, Hunter S. Breeze and Novel Efficient Blades) for high speed operation.

TABLE 4

| Fan Type | Huntington III | Hunter-Summer Breeze | Novel Efficient |
|---|---|---|---|
| Average Velocity (m/s) | 0.66 | 0.68 | 0.81 |
| Total CFM | 5813.9 | 4493.6 | 6341.1 |
| Total Watts | 61.8 | 74.8 | 62.5 |
| Total CFM/Watts | 94.1 | 60.1 | 101.5 |

As shown in Table 4 at high speed, absolute flow (CFM) (6341.1/5813.9) was increased by approximately 9% with efficiency (101.5/94.1) improved by a similar amount of approximately 7.86% when comparing the novel efficient fan blades over the Huntington III fan.

Also, at high speed, absolute flow (CFM) (6341.1/4493.6) was increased by approximately 41.1% with efficiency (101.5/60.1) improved by approximately 68.88% when comparing the novel efficient fan blades over the Hunter S. Breeze fan Although medium speed operation is not shown, extrapolating speeds between low and high, would show that the invention would have similar benefits over the Huntington III and Hunter S. Breeze ceiling fans.

The United States government has initiated a program entitled: Energy Star (www.energystar.gov) for helping businesses and individuals to protect the environment through superior energy efficiency by reducing energy consumption and which includes rating appliances such as ceiling fans that use less power than conventional fans and produce greater cfm output. As of Oct. 1, 2004, the Environmental Protection Agency (EPA) has been requiring specific air flow efficiency requirements for ceiling fan products to meet the Energy Star requirements which then allow those products to be labeled Energy Star rated. Table 5 below shows the current Energy Star Program requirements for residential ceiling fans with the manufacturer setting their own three basic speeds of Low, Medium and High.

TABLE 5

Air Flow Efficiency Requirements (Energy Star)

| Fan Speed | Mininum Airflow | Efficiency Requirement |
|---|---|---|
| Low | 1,250 CFM | 155 CFM/Watt |
| Medium | 3,000 CFM | 100 CFM/Watt |
| High | 5,000 CFM | 75 CFM/Watt |

Note, that Energy Star program does not require what the speed ranges for RPM are used for low, medium and high, but rather that the flow targets are met:

For Energy Star, residential ceiling fan airflow efficiency on a performance bases is measured as CFM of airflow per watt of power consumed by the motor and controls. This standard treats the motor, blades and controls as a system, and efficiency can be measured on each of three fan speeds (low, medium, high) using standard testing.

From Table 5, it is clear that the efficient novel blades with upper aerodynamic surfaces running at all speeds of low, medium and high meet and exceed the Energy Star Rating requirements.

Other embodiments can use as few as two, three, four, and even six efficient novel blades with upper aerodynamic surfaces. The blades can be formed from carved wood and/or injection molded plastic. The ceiling fan blades can have various diameters such as but not limited to approximately 42", 46", 48", 52", 54", 56", 60" and even greater or less as needed.

First Embodiment Small Diameter Blades

The labeled components will now be described.

Figure 1A:
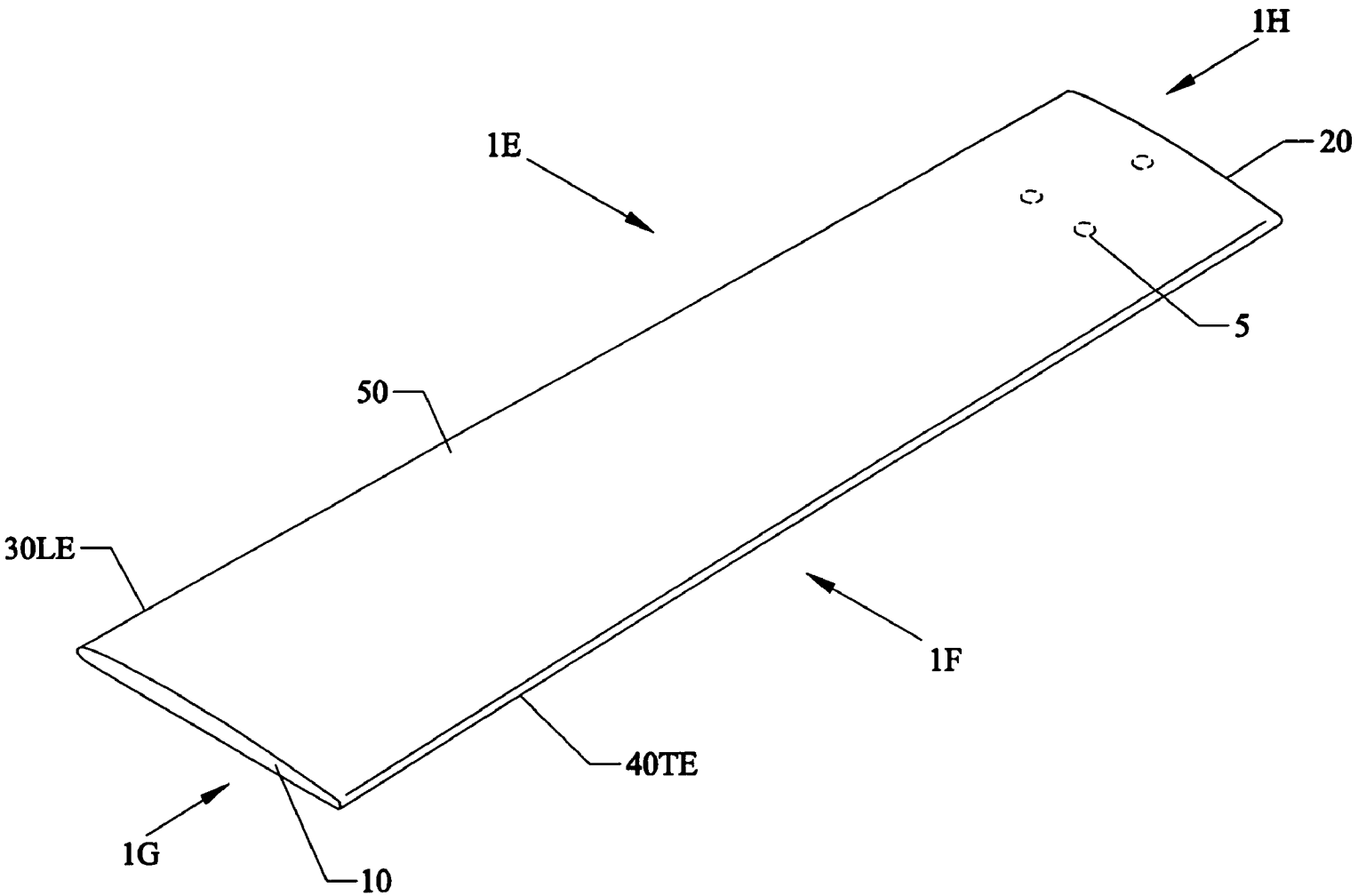
FIG. 1A is a top perspective view of a first embodiment efficient traditionally appearing ceiling fan blade with aerodynamical upper surfaces and wide tip end.
Figure 1B:
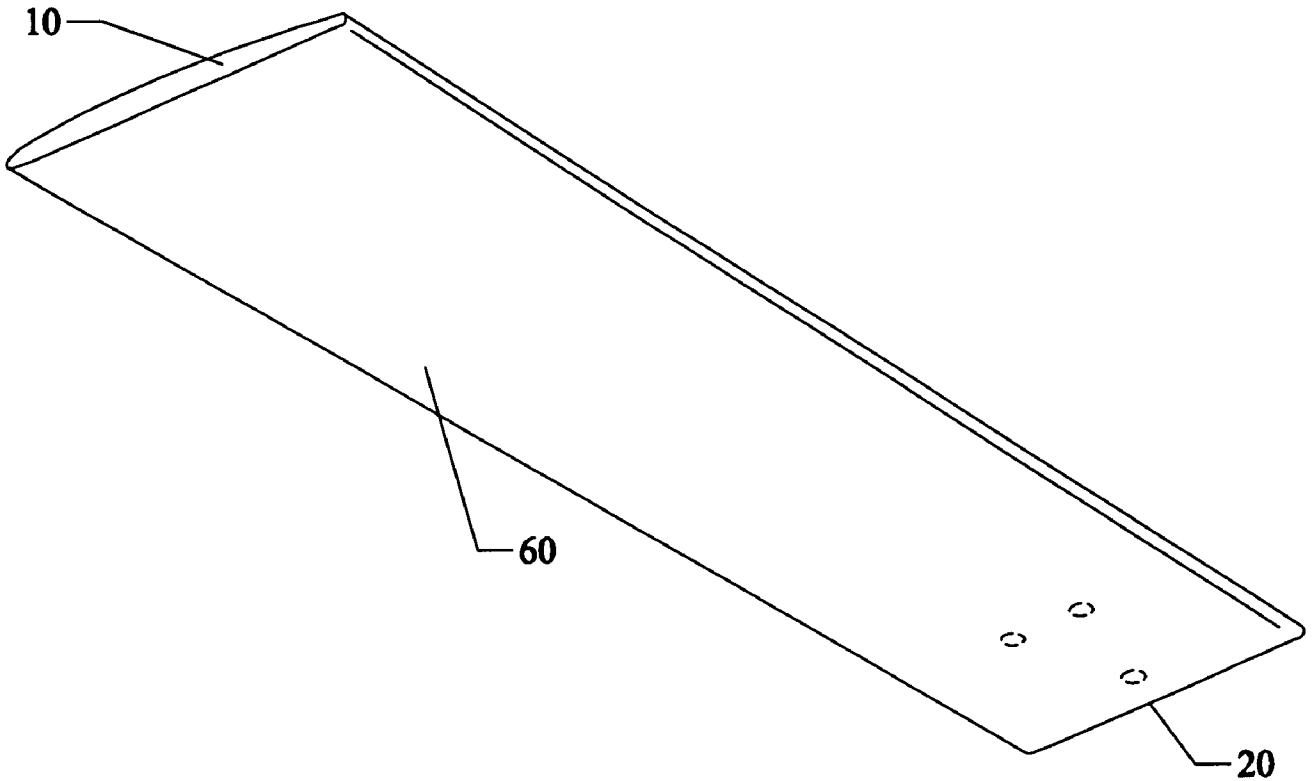
FIG. 1B is a bottom perspective view of the blade of FIG. 1A.
Figure 1C:
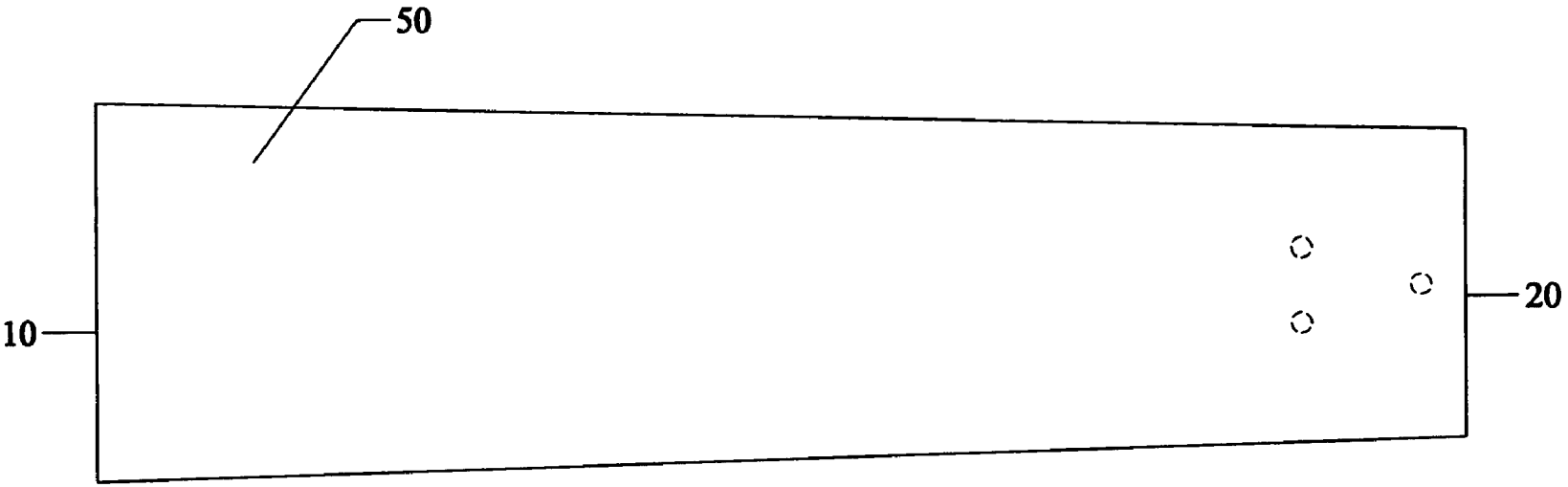
FIG. 1C is a top planar view of the blade of FIG. 1A.
Figure 1D:
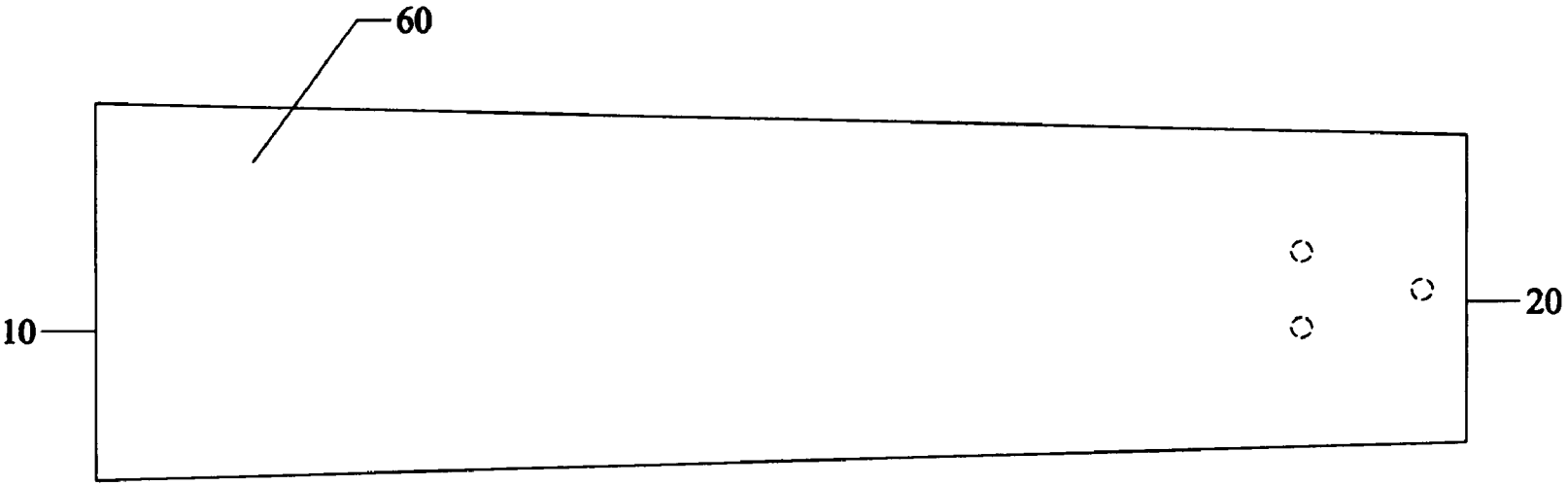
FIG. 1D is a bottom planar view of the blade of FIG. 1A.
Figure 1E:
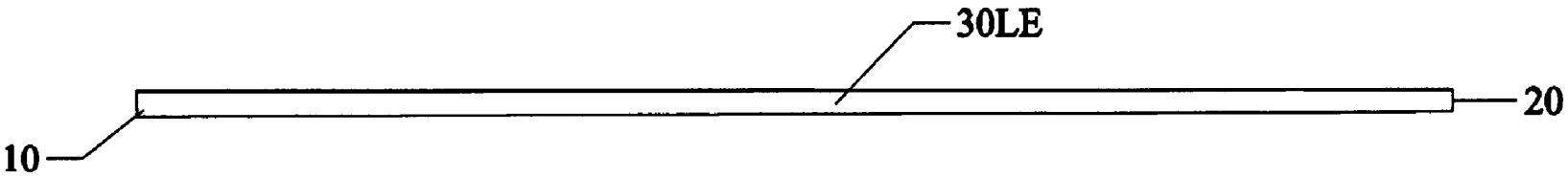
FIG. 1E is a left side view of the blade of FIG. 1A along arrow 1E.
Figure 1F:
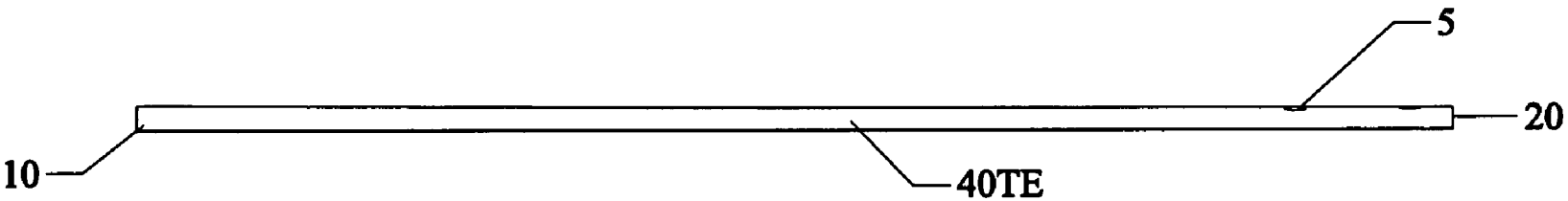
FIG. 1F is a right side view of the blade of FIG. 1A along arrow 1F.
Figure 1G:
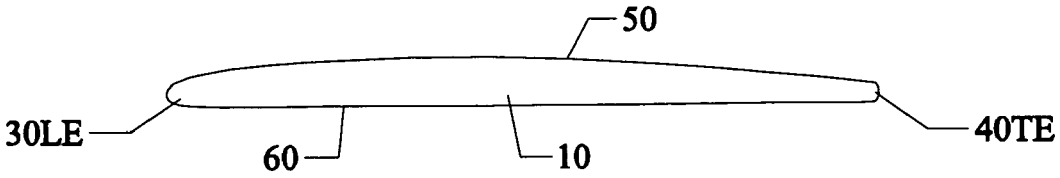
FIG. 1G is a tip end view of the blade of FIG. 1A along arrow 1G.
Figure 1H:
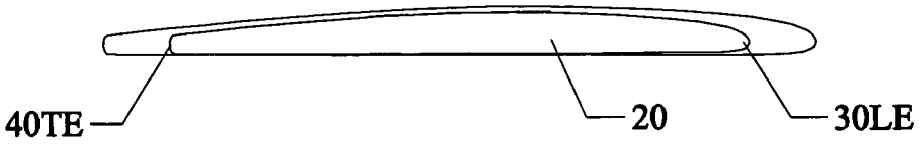
FIG. 1H is a root end view of the blade of FIG. 1A along arrow 1H.

1 novel small diameter blade
5 dotted lines for motor mount arm connection
10 tip end
20 root end
30LE leading edge
40TE trailing edge
50 upper surface
60 lower surface FIG. 1A is a top perspective view of a first embodiment efficient traditionally appearing ceiling fan blade 1 with aerodynamical upper surfaces 50 and wide tip end 10. FIG. 1B is a bottom perspective view of the blade 1 of FIG. 1A with planar/flat appearing lower surface 60. FIG. 1C is a top planar view of the blade 1 of FIG. 1A showing upper surface 50. FIG. 1D is a bottom planar view of the blade 1 of FIG. 1A. FIG. 1E is a left side view of the blade 1 of FIG. 1A along arrow 1E with leading edge 30LE. FIG. 1F is a right side view of the blade 1 of FIG. 1A along arrow 1F with trailing edge 40TE FIG. 1G is a tip end 10 view of the blade 1 of FIG. 1A along arrow 1G. FIG. 1H is a root end 20 view of the blade 1 of FIG. 1A along arrow 1H.

Referring to FIGS. 1A-1G, the novel blade can have an overall length between root end 20 and tip end 10 of approximately 20 inches, where the root end can have a diameter of approximately 3.53 inches that widens outward along blade 1 to the tip end that can have a diameter of approximately 4.53 inches. The tip end 10 and root end 20 can have flat generally flat face ends. The undersurface 60 of blade 1 can be flat and planar so as to appear to be a traditionally appearing flat sided blade when viewed from underneath the blades when mounted to a ceiling fan.

The upper surface 50 can have an efficient aerodynamic surface with a rounded leading edge 30LE, and a blunt tipped trailing edge 40TE. The upper surfaces of the blade 1 can include an upwardly curving slope from the rounded leading edge 30LE to a point of maximum thickness, the point being closer to the leading edge 30LE than to the trailing edge 40TE. The upper surface can also include a downwardly curving slope from the maximum thickness point to the blunt tipped trailing edge 40TE. The thickness along this maximum thickness point can run along a longitudinal axis from the root end to the tip end, and this maximum thickness can be thicker than the thickness along either or both of the leading edge 30LE and the trailing edge 40TE.

Figure 2:
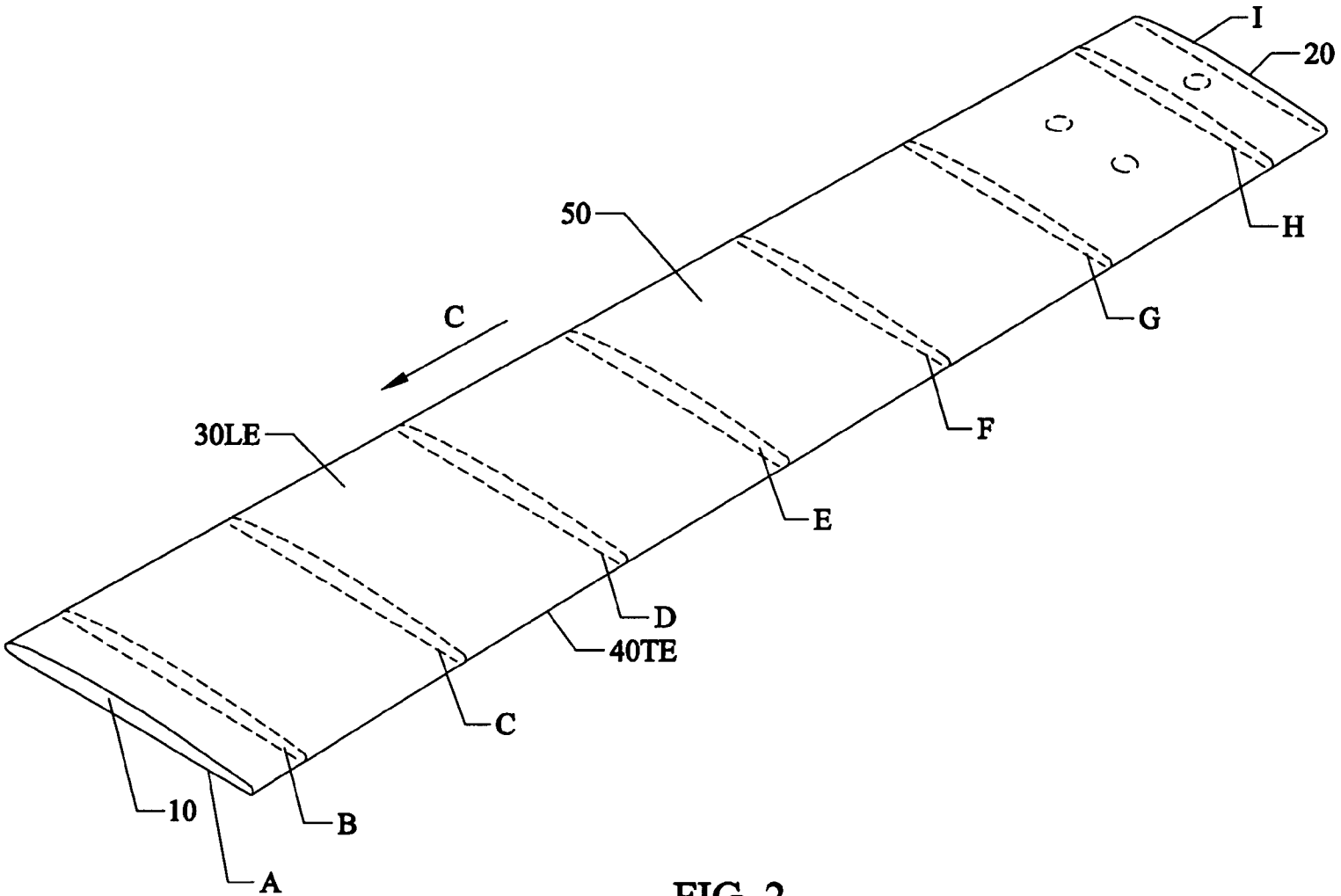
FIG. 2 is another top perspective view of the efficient traditionally appearing ceiling fan blade with aerodynamical upper surfaces and wide tip end of FIG. 1A with labeled cross-sections A, B, C, D, E, F, G, H, I
Figure 3:
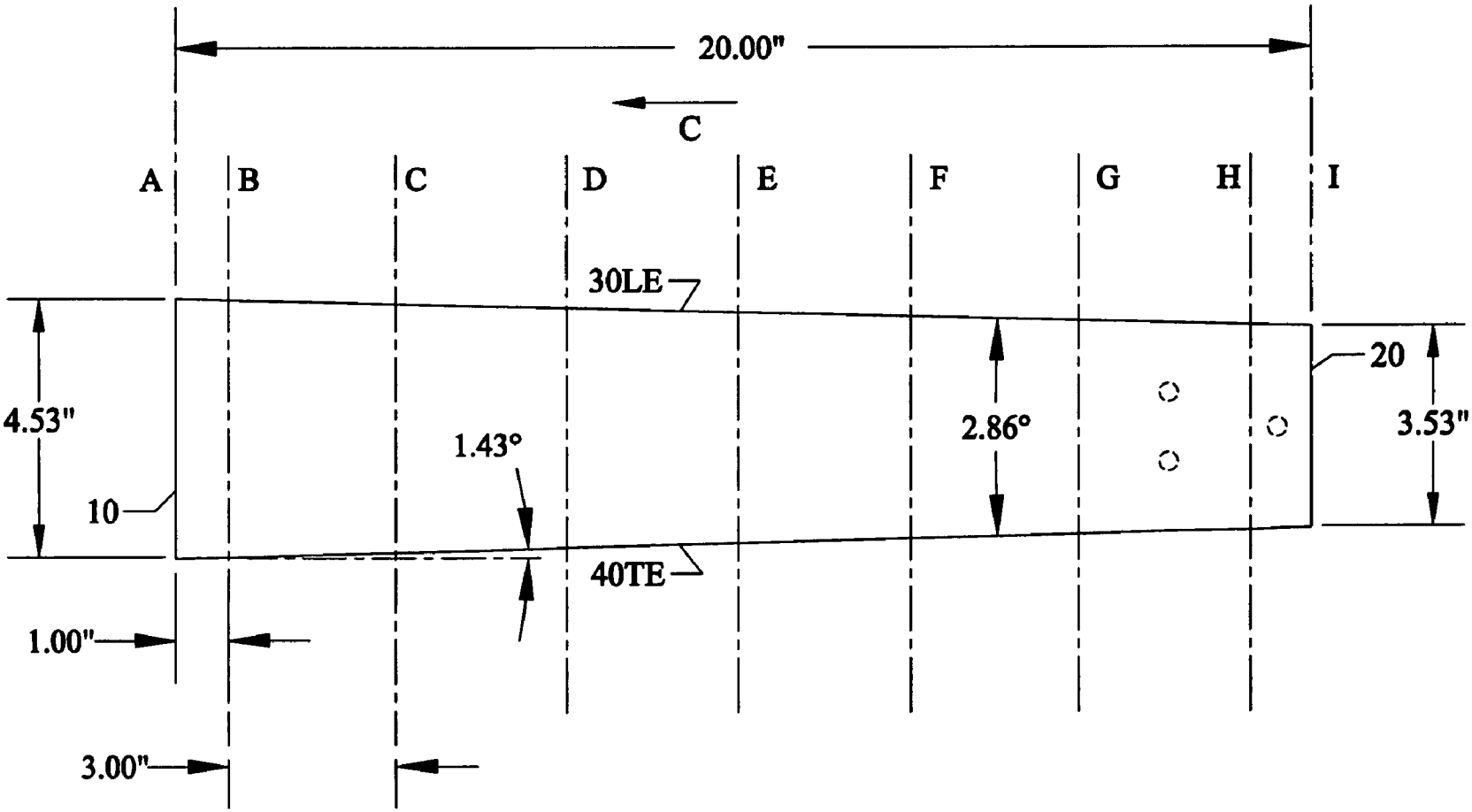
FIG. 3 is another top view of the efficient traditionally appearing ceiling fan blade with aerodynamical upper surfaces of FIG. 1A with labeled cross-sections A-I.

FIG. 2 is another top perspective view of the efficient traditionally appearing ceiling fan blade 1 with aerodynamical upper surfaces 50 and wide tip end 10 of FIG. 1A with labeled cross-sections A, B, C, D, E, F, G, H, I. FIG. 3 is another top view of the efficient traditionally appearing ceiling fan blade 1 with aerodynamical upper surfaces 50 of FIG. 1A with labeled cross-sections A-I.

Referring to FIGS. 2-3, blade 1 has an overall length of approximately 20" and a width that varies from the root end 20 being approximately 3.53" to the tip end 10 being approximately 4.53". Cross-section A is taken at the tip end 10 with cross-section B approximately 1" in and cross-sections C, D, E, F, G, H spaced approximately 3" apart from one another. Cross-section I is taken a root end 20 with cross-section H approximately 1" from root end 20. FIGS. 4A-4I are individual cross-sectional views of FIGS. 2-3 taken in the direction of arrow C FIG. 4A shows the cross-section A of FIGS. 2-3 having a width of approximately 4.53", a flat bottom and an aerodynamic upper surface that starts from blunt trailing edge 40TE sloping upward along a convex curve to a halfway thickness of approximately 0.27" to a maximum thickness of the section A being approximately 0.32" that is spaced approximately 1.82" from the rounded leading edge 30LE. A halfway thickness of approximately 0.29" is located on a downwardly convex curve slope between the maximum thickness point and the rounded leading edge 30LE.

Figure 4B:
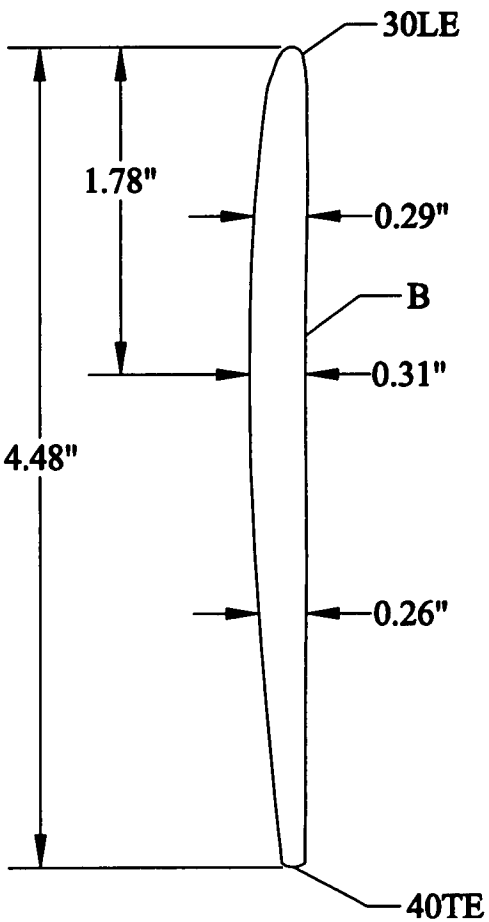
FIG. 4B shows the cross-section B of FIGS. 2-3.
Figure 4A:
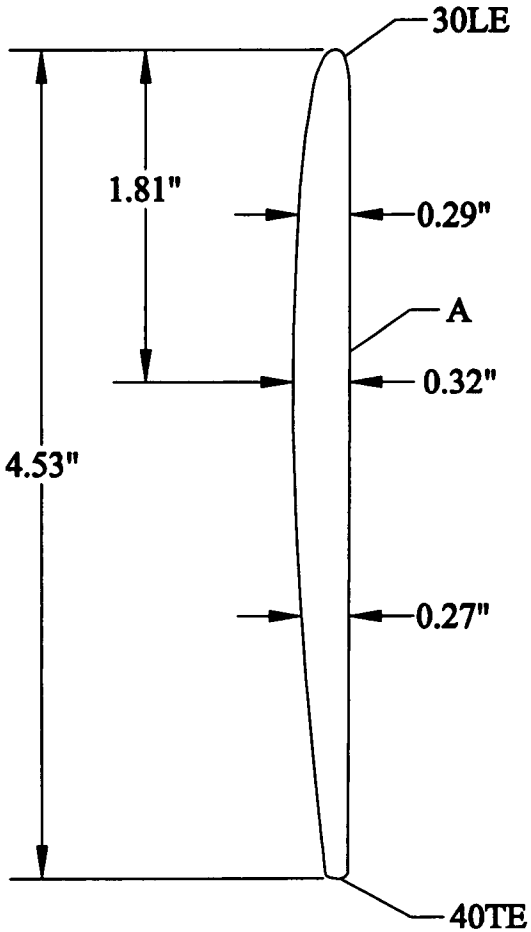
FIG. 4A shows the cross-section A of FIGS. 2-3.

FIG. 4B shows the cross-section B of FIGS. 2-3 having a width of approximately 4.48", a flat bottom and an aerodynamic upper surface that starts from blunt trailing edge 40TE sloping upward along a convex curve to a halfway thickness of approximately 0.26" to a maximum thickness of the section B being approximately 0.31" that is spaced approximately 1.78" from the rounded leading edge 30LE. A halfway thickness of approximately 0.29" is located on a downwardly convex curve slope between the maximum thickness point and the rounded leading edge 30LE.

Figure 4D:
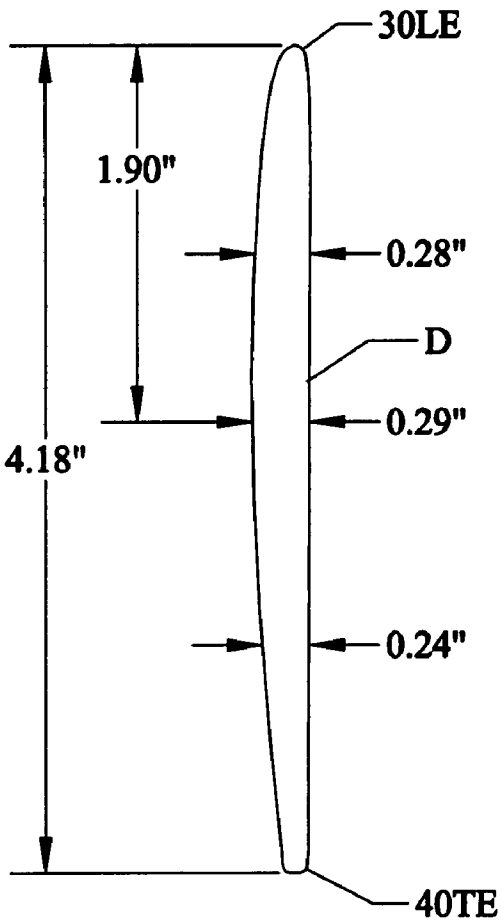
FIG. 4D shows the cross-section D of FIGS. 2-3.
Figure 4C:
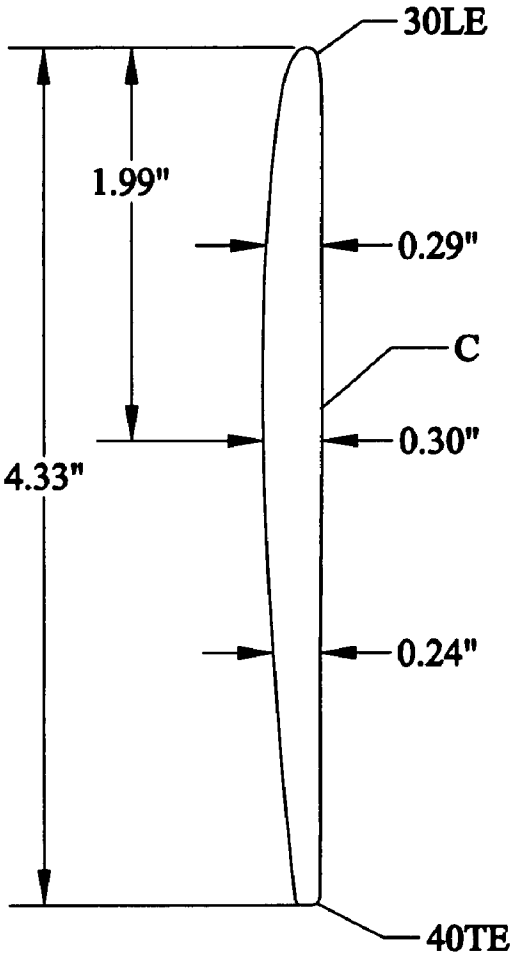
FIG. 4C shows the cross-section C of FIGS. 2-3.

FIG. 4C shows the cross-section C of FIGS. 2-3 having a width of approximately 4.33", a flat bottom and an aerodynamic upper surface that starts from blunt trailing edge 40TE sloping upward along a convex curve to a halfway thickness of approximately 0.24" to a maximum thickness of the section C being approximately 0.30" that is spaced approximately 1.99" from the rounded leading edge 30LE. A halfway thickness of approximately 0.29" is located on a downwardly convex curve slope between the maximum thickness point and the rounded leading edge 30LE.

FIG. 4D shows the cross-section D of FIGS. 2-3 having a width of approximately 4.18", a flat bottom and an aerodynamic upper surface that starts from blunt trailing edge 40TE sloping upward along a convex curve to a halfway thickness of approximately 0.24" to a maximum thickness of the section D being approximately 0.29" that is spaced approximately 1.90" from the rounded leading edge 30LE. A halfway thickness of approximately 0.28" is located on a downwardly convex curve slope between the maximum thickness point and the rounded leading edge 30LE.

Figure 4F:
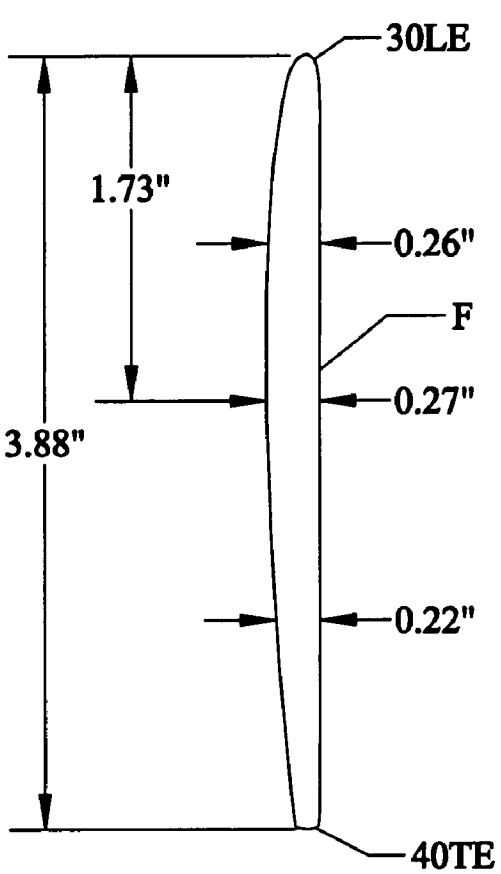
FIG. 4F shows the cross-section F of FIGS. 2-3.
Figure 4E:
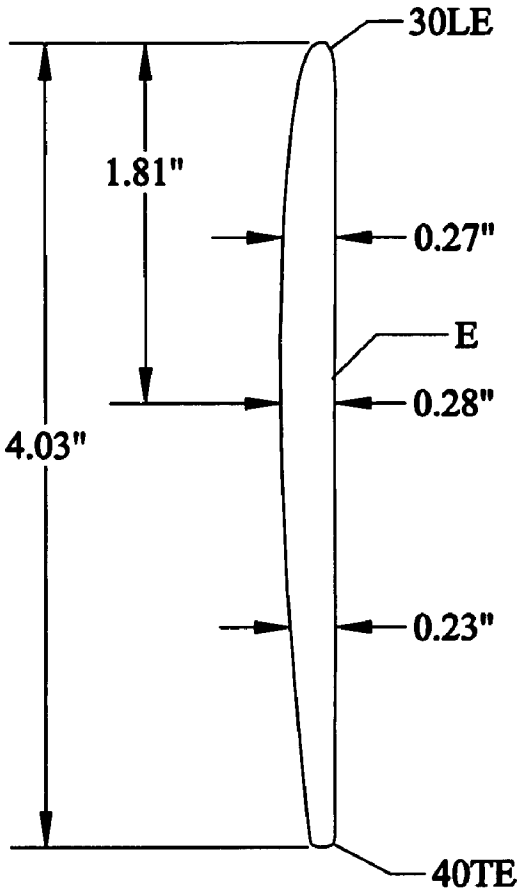
FIG. 4E shows the cross-section E of FIGS. 2-3.

FIG. 4E shows the cross-section E of FIGS. 2-3 having a width of approximately 4.03", a flat bottom and an aerodynamic upper surface that starts from blunt trailing edge 40TE sloping upward along a convex curve to a halfway thickness of approximately 0.23" to a maximum thickness of the section E being approximately 0.28" that is spaced approximately 1.81" from the rounded leading edge 30LE. A halfway thickness of approximately 0.27" is located on a downwardly convex curve slope between the maximum thickness point and the rounded leading edge 30LE.

FIG. 4F shows the cross-section F of FIGS. 2-3 having a width of approximately 3.88", a flat bottom and an aerodynamic upper surface that starts from blunt trailing edge 40TE sloping upward along a convex curve to a halfway thickness of approximately 0.22" to a maximum thickness of the section F being approximately 0.27" that is spaced approximately 1.73" from the rounded leading edge 30LE. A halfway thickness of approximately 0.26" is located on a downwardly convex curve slope between the maximum thickness point and the rounded leading edge 30LE.

Figure 4I:
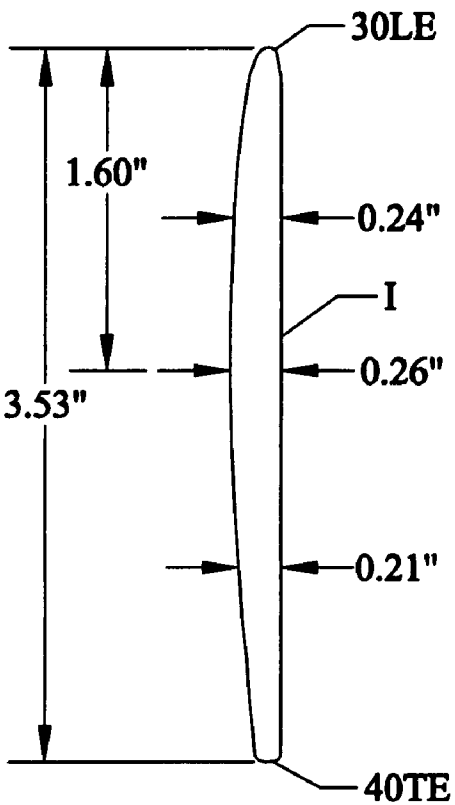
FIG. 4I shows the cross-section I of FIGS. 2-3.
Figure 4H:
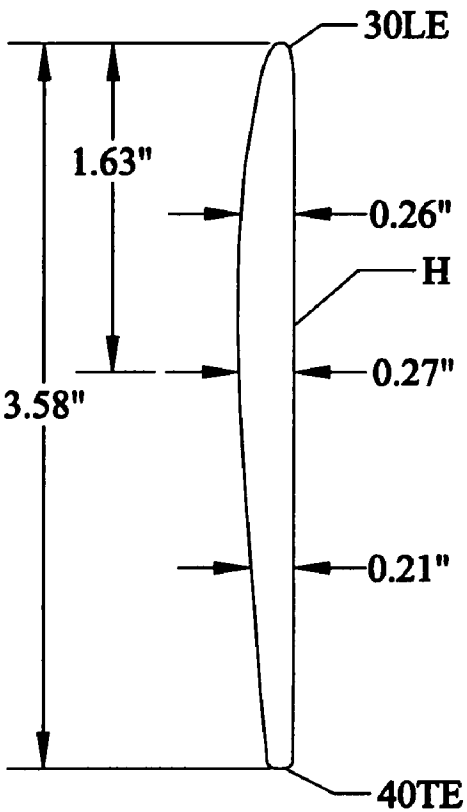
FIG. 4H shows the cross-section H of FIGS. 2-3.
Figure 4G:
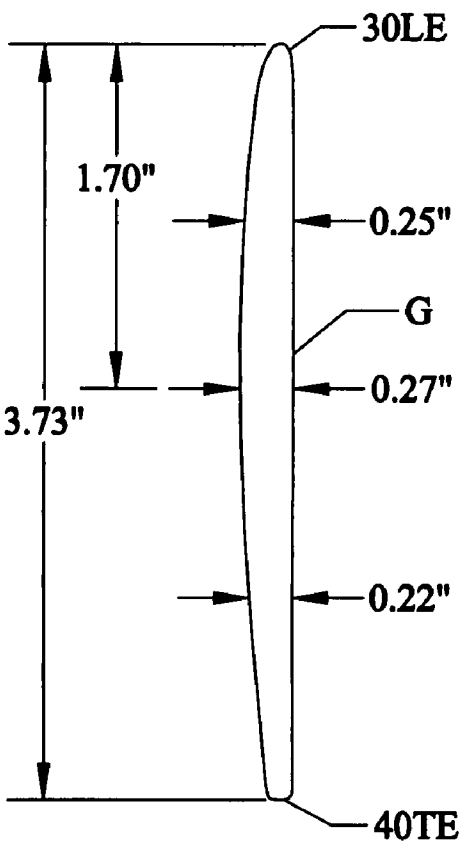
FIG. 4G shows the cross-section G of FIGS. 2-3.

FIG. 4G shows the cross-section G of FIGS. 2-3 having a width of approximately 3.73", a flat bottom and an aerodynamic upper surface that starts from blunt trailing edge 40TE sloping upward along a convex curve to a halfway thickness of approximately 0.22" to a maximum thickness of the section G being approximately 0.27" that is spaced approximately 1.70" from the rounded leading edge 30LE. A halfway thickness of approximately 0.25" is located on a downwardly convex curve slope between the maximum thickness point and the rounded leading edge 30LE.

FIG. 4H shows the cross-section H of FIGS. 2-3 having a width of approximately 3.58", a flat bottom and an aerodynamic upper surface that starts from blunt trailing edge 40TE sloping upward along a convex curve to a halfway thickness of approximately 0.21" to a maximum thickness of the section H being approximately 0.27" that is spaced approximately 1.63" from the rounded leading edge 30LE. A halfway thickness of approximately 0.26" is located on a downwardly convex curve slope between the maximum thickness point and the rounded leading edge 30LE.

FIG. 4I shows the cross-section I of FIGS. 2-3 having a width of approximately 3.53", a flat bottom and an aerodynamic upper surface that starts from blunt trailing edge 40TE sloping upward along a convex curve to a halfway thickness of approximately 0.21" to a maximum thickness of the section I being approximately 0.26" that is spaced approximately 1.60" from the rounded leading edge 30LE. A halfway thickness of approximately 0.24" is located on a downwardly convex curve slope between the maximum thickness point and the rounded leading edge 30LE.

Second Embodiment Large Diameter Blades

The labeled components will now be described.

101 novel large diameter blade
105 dotted lines for motor mount arm connection
110 tip end
120 root end
130LE leading edge
140TE trailing edge
150 upper surface
160 lower surface FIG. 5 is a top perspective view of a second embodiment of a large efficient traditionally appearing ceiling fan blade 101 with aerodynamical upper surfaces 150 and wide tip end 110 with labeled cross-sections A, B, C, D, E, F, G, H. FIG. 6 is a top view of the large efficient traditionally appearing ceiling fan blade 101 with aerodynamical upper surfaces 150 of FIG. 5 with labeled cross-sections A-H.

Referring to FIGS. 5-6, blade 101 has an overall length of approximately 21.08" and a width that varies from the root end 120 being approximately 4.85" to the tip end 110 being approximately 5.95". Cross-section A is taken at the tip end 110 with cross-section B approximately 1" in and cross-sections C, D, E, F, G spaced approximately 3.96" apart from one another. Cross-section H is taken a root end 120 with cross-section G approximately 1" from root end 120. FIGS. 4A-4H are individual cross-sectional views of FIGS. 5-6 taken in the direction of arrow C.

FIG. 7A shows the cross-section A of FIGS. 5-6 having a width of approximately 5.95", a flat bottom and an aerodynamic upper surface that starts from blunt trailing edge 140TE sloping upward along a convex curve to a halfway thickness of approximately 0.33" to a maximum thickness of the section A being approximately 0.41" that is spaced approximately 2.70" from the rounded leading edge 130LE. A halfway thickness of approximately 0.39" is located on a downwardly convex curve slope between the maximum thickness point and the rounded leading edge 130LE.

FIG. 7B shows the cross-section B of FIGS. 5-6 having a width of approximately 5.90", a flat bottom and an aerodynamic upper surface that starts from blunt trailing edge 140TE sloping upward along a convex curve to a halfway thickness of approximately 0.32" to a maximum thickness of the section B being approximately 0.41" that is spaced approximately 2.70" from the rounded leading edge 130LE. A halfway thickness of approximately 0.39" is located on a downwardly convex curve slope between the maximum thickness point and the rounded leading edge 130LE.

FIG. 7C shows the cross-section C of FIGS. 5-6 having a width of approximately 5.70", a flat bottom and an aerodynamic upper surface that starts from blunt trailing edge 140TE sloping upward along a convex curve to a halfway thickness of approximately 0.31" to a maximum thickness of the section C being approximately 0.40" that is spaced approximately 2.60" from the rounded leading edge 130LE. A halfway thickness of approximately 0.38" is located on a downwardly convex curve slope between the maximum thickness point and the rounded leading edge 130LE.

FIG. 7D shows the cross-section D of FIGS. 5-6 having a width of approximately 5.50", a flat bottom and an aerodynamic upper surface that starts from blunt trailing edge 140TE sloping upward along a convex curve to a halfway thickness of approximately 0.31" to a maximum thickness of the section D being approximately 0.39" that is spaced approximately 2.46" from the rounded leading edge 130LE. A halfway thickness of approximately 0.36" is located on a downwardly convex curve slope between the maximum thickness point and the rounded leading edge 130LE.

FIG. 7E shows the cross-section E of FIGS. 5-6 having a width of approximately 5.30", a flat bottom and an aerodynamic upper surface that starts from blunt trailing edge 140TE sloping upward along a convex curve to a halfway thickness of approximately 0.31" to a maximum thickness of the section E being approximately 0.37" that is spaced approximately 2.38" from the rounded leading edge 130LE. A halfway thickness of approximately 0.35" is located on a downwardly convex curve slope between the maximum thickness point and the rounded leading edge 130LE.

FIG. 7F shows the cross-section F of FIGS. 5-6 having a width of approximately 5.10", a flat bottom and an aerodynamic upper surface that starts from blunt trailing edge 140TE sloping upward along a convex curve to a halfway thickness of approximately 0.29" to a maximum thickness of the section F being approximately 0.36" that is spaced approximately 2.29" from the rounded leading edge 130LE. A halfway thickness of approximately 0.35" is located on a downwardly convex curve slope between the maximum thickness point and the rounded leading edge 130LE.

FIG. 7G shows the cross-section G of FIGS. 5-6 having a width of approximately 4.90", a flat bottom and an aerodynamic upper surface that starts from blunt trailing edge 140TE sloping upward along a convex curve to a halfway thickness of approximately 0.30" to a maximum thickness of the section G being approximately 0.36" that is spaced approximately 2.24" from the rounded leading edge 130LE. A halfway thickness of approximately 0.33" is located on a downwardly convex curve slope between the maximum thickness point and the rounded leading edge 130LE.

FIG. 7H shows the cross-section H of FIGS. 5-6 having a width of approximately 4.85", a flat bottom and an aerodynamic upper surface that starts from blunt trailing edge 140TE sloping upward along a convex curve to a halfway thickness of approximately 0.29" to a maximum thickness of the section H being approximately 0.35" that is spaced approximately 2.22" from the rounded leading edge 130LE. A halfway thickness of approximately 0.33" is located on a downwardly convex curve slope between the maximum thickness point and the rounded leading edge 130LE.

FIG. 8A is a perspective bottom view of a ceiling fan 200 and efficient blades 1/101 of FIGS. 1-71, with the blades 1/101 attached a ceiling mounted motor 210. FIG. 8B is a perspective top view of the ceiling fan 200 and efficient blades 1/101 of FIG. 8A. FIG. 8C is a side perspective view of the ceiling fan 100 and efficient blades 1/101 of FIG. 8A. FIG. 8D is a bottom view of the ceiling fan 200 and efficient blades 1/101 of FIG. 8A. FIG. 8E is a top view of the ceiling fan 200 and efficient blades 1/101 of FIG. 8A.

Referring to FIGS. 8A-8E, one viewing beneath the ceiling fan would see bottom surfaces 60/160 that appear to be traditionally flat/planar ceiling fan blades. With the aerodynamical upper surfaces 50/150 not visible from ground level. The novel blades 1/101 can be mounted at angles or twisted by respective mounting arms 250 to further maximize airflow.

Third Embodiment Rounded Wide Tip End Blades

The labeled components will now be described.

301 novel efficient aerodynamic blade with rounded tip end
305 dotted lines for motor mount arm connection
310 tip end
320 root end
330LE leading edge
340TE trailing edge

350 upper surface
360 lower surface

FIG. 9A is a top perspective view of a third embodiment efficient traditionally appearing ceiling fan blade 301 with aerodynamical upper surfaces 350 and rounded wide tip end 310. FIG. 9B is a bottom perspective view of the blade 301 of FIG. 9A. FIG. 9C is a top planar view of the blade 301 of FIG. 9A. FIG. 9D is a bottom planar view of the blade 301 of FIG. 9A. FIG. 9E is a left side view of the blade 301 of FIG. 9A along arrow 9E. FIG. 9F is a right side view of the blade of FIG. 9A along arrow 9F. FIG. 9G is a tip end 310 view of the blade 301 of FIG. 9A along arrow 9G. FIG. 9H is a root end 320 view of the blade 301 of FIG. 9A along arrow 9H. Referring to FIGS. 9A, 9H, the third embodiment has similar attributes to that of the preceding embodiments with the addition of having the tip end 310 being rounded.

Fourth Embodiment Curved Wide Tip End Blades

The labeled components will now be described.

401 novel efficient aerodynamic blade with curved tip end
405 dotted lines for motor mount arm connection
410 tip end
420 root end
430 leading edge
440 trailing edge
450 upper surface
460 lower surface FIG. 10A is a top perspective view of a fourth embodiment efficient traditionally appearing ceiling fan blade 401 with aerodynamical upper surfaces 450 and curved wide tip end 410. FIG. 10B is a bottom perspective view of the blade 401 of FIG. 10A. FIG. 10C is a top planar view of the blade 401 of FIG. 10A. FIG. 10D is a bottom planar view of the blade 401 of FIG. 10A. FIG. 10E is a left side view of the blade 401 of FIG. 10A along arrow 10E. FIG. 10F is a right side view of the blade 401 of FIG. 10A along arrow 10F. FIG. 10G is a tip end 410 view of the blade of FIG. 10A along arrow 10G. FIG. 10H is a root end 420 view of the blade of FIG. 10A along arrow 10H. Referring to FIGS. 10A-10H, the fourth embodiment has similar attributes to that of the preceding embodiments with the addition of having the tip end 410 being curved.

Fifth Embodiment Separately Attachable Aerodynamic Surface

The labeled components will now be described.

501 novel blade with attachable upper aerodynamic surface
560 tip end
570 root end
530 leading edge
540 trailing edge
550 Separately attachable aerodynamic upper surface
505 Lower traditional flat planar sided blade FIG. 11 is tip end exploded view of a separate attachable aerodynamic surface form 550 that can be attached to conventional flat-planar surface ceiling fan blades 505. FIG. 12 is another view of FIG. 11 with the aerodynamic surface 550 attached to the blade 505. A traditional blade 505 can have existing flat/planar upper surface 510 and flat/planar lower surface 520. A separate form 550 can have a flat lower surface 555, and aerodynamic upper surface 557. The lower surface 555 can be attached to the existing upper flat/planar surface 510 of the traditional blades 505 by glue, cement, and the like, and/or using fasteners such as but not limited to screws, and the like, where the resulting blade 501 can have similar dimensions and the resulting benefits as the previous embodiments described above.

FIG. 13 is another version 581 of the separately attachable aerodynamic surface 580 with blade 560/570. The add-on 580 can have an upper aerodynamic surface that slopes upward from trailing edge 582 and curves down to an overhanging rounded leading edge 588 to fit about the leading edge of the underlying flat blade 560/570. The add-on can be attached similar to the add-on previously described, such as by glue, cement, and the like, and/or using fasteners 590 such as but not limited to screws, and the like, where the resulting blade 581 can have similar dimensions and the resulting benefits as the previous embodiments described above.

The preferred embodiments can be used with blades that rotate clockwise or counter-clockwise, where the blades can be positioned to maximize airflow in either rotational directions.

While the preferred embodiment includes providing aerodynamic surfaces on the upper surface of planar/flat bladed fans, the invention can be practiced with other ceiling fan blades that can achieve enhanced airflow and efficiency results. For example, design and aesthetic appearing blades can include upper surfaces that have the efficient aerodynamic efficient surfaces.

The blade mounting arms can also be optimized in shape to allow the blades to optimize pitch for optimal airflow with or without the efficient aerodynamic upper surface blades.

Although the preferred embodiments show the efficient aerodynamic surfaces on the top of the blades, the blades can alternatively also have aerodynamic efficient surfaces on the bottom side. Alternatively, both the top and bottom surfaces can have the novel aerodynamic efficient surfaces.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A high efficiency traditional appearing ceiling fan comprising:

a hub with a motor; and a plurality of solid plastic molded base blades attached to the ceiling fan motor, each blade having a flat and planar lower surfaces that visually appear to be flat and planar when viewed underneath the fan, and flat and planar upper surfaces, each of the base blades being having a substantially uniform thickness between a flat root end and a tip end that is wider than the flat root end, the base blades being contiguous except for the root end having a plurality of mounting holes therethrough for attaching to a blade arm, the base blades having a leading edge and a blunt tipped trailing edge; and separate attachable aerodynamic attachment members, each being formed from solid molded plastic, having a lower surface that is flat and planar and has a root end identical in width to the root end of the base blades, and a tip end identical in width to the tip end of the base blades, the lower surface of the aerodynamic attachment members being attached to the flat and planar upper surfaces of the base blades, the aerodynamic attachment members having upper surfaces with a single upwardly curving slope from a leading edge to a point of maximum thickness that is closer to the leading edge than to a trailing edge, the aerodynamic upper surfaces having a single downwardly curving slope from the maximum thickness point to the trailing edge, each of the aerodynamic attachment members having a mid-thickness along a longitudinal axis of the aerodynamic attachment members being thicker than both thicknesses along the leading edge and the trailing edge of the aerodynamic attachment members, the aerodynamic attachment members having an overhanging rounded leading edge for fitting and wrapping about a leading edge on each base blade, the overhanging leading edge having a lower flat surface which is even with the lower flat surface of the base blade, so that both the lower flat surface of the base blade and the lower flat surface of the overhanging leading edge of the aerodynamic attachment members appear to be flat and contiguous with one another when viewed from below the ceiling fan, the aerodynamic attachment members having a trailing edge that extends no farther than the blunt tipped trailing edge of the base blades so that the blunt tipped trailing edge of the base blades remains visible thereon, wherein the aerodynamic upper surfaces of the attachment members when used with the base blades provide increased airflow over blades having both upper and lower flat and planar surfaces.

2. The high efficiency traditional appearing ceiling fan of claim 1, further comprising: an adhesive selected from at least one of cement and glue, for attaching the aerodynamic attachment members to the base members.

3. The high efficiency traditional appearing ceiling fan of claim 1, further comprising: screw fasteners for attaching the aerodynamic attachment members to the base members.

4. A high efficiency adapter for a traditional appearing ceiling fan blade, comprising in combination:

a separate attachable aerodynamic attachment member for attaching to flat and planar upper surfaces between a root end and a tip end of a conventional ceiling fan blade that has flat and planar upper and lower sides, the aerodynamic attachment member having an upper surface with a single upwardly curving slope from a leading edge to a point of maximum thickness that is closer to the leading edge than to a trailing edge, the aerodynamic upper surface having a kinds downwardly curving slope from the maximum thickness point to the trailing edge the attachment member having a mid-thickness along a longitudinal axis of the conventional blade being thicker than both thicknesses along the leading edge and the trailing edge of the conventional blade, the attachment member having a flat planar lower surface identical in width between a root end a tip end to the root end and the tip end of the conventional ceiling fan blade, the attachment member having an overhanging rounded leading edge for fitting and wrapping about a leading edge on the conventional ceiling fan blade, the overhanging leading edge having a lower flat surface which is even with the flat planar lower side of the conventional blade, so that both the flat planar lower side of the conventional blade and the lower flat surface of the overhanging leading edge of the attachment member appear to be flat and contiguous with one another when viewed from below the ceiling fan, the attachment member having a trailing edge that extends no further than a trailing edge of the conventional blade so that the trailing edge of the conventional blade remains visible thereon; and a fastening member for attaching the flat planar lower surface of the separate attachable aerodynamic attachment member to the flat and planar upper surfaces of the conventional blade, wherein the aerodynamic upper surface of the attachment member when used with the conventional ceiling fan blade provide increased airflow over the conventional ceiling fan blades that has both upper and lower flat and planar surfaces.

5. The high efficiency adapter for the traditional appearing ceiling fan blade of claim 4, wherein the fastening member includes: an adhesive selected from one of glue and cement.

6. The high efficiency adapter for the traditional appearing ceiling fan blade of claim 4, wherein the fastening member includes: at least one screw fastener.

7. The high efficiency adapter of claim 4, wherein both the root end of the attachment member and the root end of the conventional blade are flat, and the tip ends of both the attachment member and the conventional blade are wider than the root ends of both the attachment member and the conventional blade.

8. High efficiency adapters for traditional appearing ceiling fan blades, comprising:

a plurality of separate attachable aerodynamic attachment members for attaching to flat and planar upper surfaces between a root end and a tin end of conventional ceiling fan blades that have flat and planar upper and lower sides, the aerodynamic attachment members having a lower surface that is flat and planar and has a root end identical in width to the root end of the conventional blades, and a tip end identical in width to the tip end of the conventional blades, the lower surface of the aerodynamic attachment members being attached to the flat and planar upper surfaces of the base blades, the aerodynamic attachment members each having an upper surface with a single upwardly curving slope from a leading edge to a point of maximum thickness that is closer to the leading edge than to a trailing edge, each aerodynamic upper surface having a single downwardly curving slope from the maximum thickness point to the trailing edge, each attachment member having a mid-thickness along a longitudinal axis of the conventional blade being thicker than both thicknesses along the leading edge and the trailing edge of the conventional blade, each attachment member having an overhanging rounded leading edge for fitting and wrapping about a leading edge cm the conventional blade, the overhanging leading edge having a lower flat surface which is even with the flat planar lower sides of the conventional blades, so that both the flat planar lower side of the conventional blades and the lower flat surface of the overhanging leading edge of the attachment members appear to be flat and contiguous with one another when viewed from below the ceiling fan, the attachment members having a trailing edge that extends no farther than a trailing edge of the conventional blades so that the trailing edge of the conventional blades remains visible thereon; and a plurality of fastening members for attaching the flat planar lower surfaces of the separate attachable aerodynamic attachment members to the flat and planar upper surfaces of the conventional blades, wherein the aerodynamic upper surfaces of the attachment members when used with the conventional ceiling fan blades provide increased airflow over the conventional ceiling fan blades that have both upper and lower flat and planar surfaces.

9. The high efficiency adapters for the traditional appearing ceiling fan blades of claim 8, wherein the fastening members includes: an adhesive selected from one of glue and cement.

10. The high efficiency adapters of claim 9, wherein both the root end of the attachment members and the root end of the conventional blades are flat, and the tip ends of both the attachment members and the conventional blades are wider than the root ends of both the attachment members and the conventional blades.

11. The high efficiency adapters for the traditional appearing ceiling fan blades of claim 8, wherein the fastening members includes: screw fasteners.

* * * * *